US012043433B2

(12) United States Patent
Shook et al.

(10) Patent No.: US 12,043,433 B2
(45) **Date of Patent: *Jul. 23, 2024**

(54) SEAL FLATTENER

(71) Applicant: Automated Packaging Systems, LLC, Streetsboro, OH (US)

(72) Inventors: Donald P. Shook, Solon, OH (US); Jared A. Soster, Brecksville, OH (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/735,714

(22) Filed: May 3, 2022

(65) Prior Publication Data

US 2022/0258899 A1 Aug. 18, 2022

Related U.S. Application Data

(63) Continuation of application No. 15/407,570, filed on Jan. 17, 2017, now Pat. No. 11,325,733.

(Continued)

(51) Int. Cl.
*B65B 51/10* (2006.01)
*B65B 5/04* (2006.01)

(Continued)

(52) U.S. Cl.
CPC ..... *B65B 51/10* (2013.01); *B65B 5/045* (2013.01); *B65B 7/02* (2013.01); *B65B 43/123* (2013.01);

(Continued)

(58) Field of Classification Search
CPC B65B 51/10; B65B 5/045; B65B 7/02; B65B 43/123; B65B 43/267; B65B 43/30;

(Continued)

(56) References Cited

U.S. PATENT DOCUMENTS 1,980,241 A 11/1934 Wilson et al.
2,401,109 A 5/1946 Rohdin (Continued)

FOREIGN PATENT DOCUMENTS

CA 549840 12/1957

OTHER PUBLICATIONS

Search Report and Written Opinion from International Application No. PCT/US2017/013763 dated Mar. 23, 2017 (12 pages).

*Primary Examiner* — Sameh Tawfik
(74) *Attorney, Agent, or Firm* — Jon M. Isaacson

(57) ABSTRACT

An apparatus makes packages from a web of bags includes an indexing mechanism, an opening arrangement, engagement devices, and a sealing arrangement. The indexing mechanism moves the web. The opening arrangement opens a bag to form an opening so that a product can be placed into the bag. The engagement devices engage the bag and close the opening. Each engagement device includes a base, a first link, a second link, a sliding pivot, and a finger. The first link is pivotably connected to the base, and the second link is pivotably connected to the first link. The sliding pivot pivots with respect to the base and allows the second link to slide through the sliding pivot member. The finger is connected to the second link. The engagement devices pull a first and second sides of the bag in opposite directions. The sealing arrangement seals the opening of the bag.

16 Claims, 39 Drawing Sheets

Related U.S. Application Data

(60) Provisional application No. 62/278,520, filed on Jan. 14, 2016.

(51) Int. Cl.

| | |
|---|---|
| ***B65B 7/02*** | (2006.01) |
| ***B65B 43/12*** | (2006.01) |
| ***B65B 43/26*** | (2006.01) |
| ***B65B 43/30*** | (2006.01) |
| ***B65B 43/34*** | (2006.01) |
| ***B65B 43/36*** | (2006.01) |
| ***B65B 51/14*** | (2006.01) |
| ***B65B 61/12*** | (2006.01) |
| ***B65B 65/02*** | (2006.01) |
| *B65B 5/02* | (2006.01) |

(52) U.S. Cl.
CPC ..... *B65B 43/267* (2013.01); *B65B 43/30* (2013.01); *B65B 43/34* (2013.01); *B65B 43/36* (2013.01); *B65B 51/146* (2013.01); *B65B 61/12* (2013.01); *B65B 65/02* (2013.01); *B65B 5/022* (2013.01)

(58) Field of Classification Search
CPC ..... B65B 43/34; B65B 43/36; B65B 51/146; B65B 61/12; B65B 65/02; B65B 5/022
USPC ..... 53/139.2
See application file for complete search history.

(56) References Cited

U.S. PATENT DOCUMENTS

| | | | | |
|---|---|---|---|---|
| 2,490,940 | A | 12/1949 | Barker | |
| 2,628,013 | A | 2/1953 | Vogt | |
| 2,998,340 | A | 8/1961 | Conway et al. | |
| 3,015,918 | A | 1/1962 | Schoen | |
| 3,027,065 | A | 3/1962 | Lindquist et al. | |
| 3,060,653 | A | 10/1962 | Flax | |
| 3,254,828 | A | 6/1966 | Lerner | |
| 3,285,405 | A | 11/1966 | Wanderer | |
| 3,487,958 | A * | 1/1970 | Costa | E02F 3/434 414/685 |
| 3,673,757 | A | 7/1972 | Willis | |
| 3,750,721 | A | 8/1973 | Hudson | |
| 3,793,797 | A | 2/1974 | Roberts et al. | |
| 4,172,349 | A | 10/1979 | Lipes | |
| 4,179,867 | A | 12/1979 | Bodolay | |
| 4,201,029 | A | 5/1980 | Lerner et al. | |
| 4,244,159 | A | 1/1981 | Gess | |
| 4,510,736 | A | 4/1985 | Mueller | |
| 4,580,391 | A | 4/1986 | Tetenborg et al. | |
| 4,805,381 | A | 2/1989 | Hannon | |
| 4,825,568 | A * | 5/1989 | Kawamura | E02F 3/432 414/722 |
| 5,301,492 | A | 4/1994 | Kader | |
| 5,375,396 | A * | 12/1994 | Huwelmann | B65B 43/54 53/570 |
| 5,470,300 | A | 11/1995 | Terranova | |
| 5,693,163 | A | 12/1997 | Hoover et al. | |
| 5,802,817 | A | 9/1998 | Hood | |
| 6,094,895 | A | 8/2000 | Ravizza | |
| 6,134,864 | A * | 10/2000 | McGregor | B65B 7/06 53/469 |
| 6,138,723 | A | 10/2000 | Wagner | |
| 6,742,321 | B2 | 6/2004 | Gates | |
| 6,948,296 | B1 | 9/2005 | Lerner et al. | |
| 7,178,314 | B2 | 2/2007 | Chomik | |
| 7,448,185 | B2 | 11/2008 | Zeedyk et al. | |
| 7,654,064 | B2 | 2/2010 | Riccardi et al. | |
| 7,950,205 | B2 * | 5/2011 | Gates | B65G 59/08 221/45 |
| 8,261,785 | B2 * | 9/2012 | Koga | B65B 43/465 141/10 |
| 2005/0022467 | A1 | 2/2005 | Kujubu et al. | |
| 2017/0203867 | A1 * | 7/2017 | Shook | B65B 43/267 |

* cited by examiner

SEAL FLATTENER

CROSS REFERENCE TO RELATED APPLICATIONS

This application is a continuation of U.S. patent application Ser. No. 15/407,570, filed Jan. 17, 2017, which claims the benefit of U.S. Provisional Patent Application No. 62/278,520, filed Jan. 14, 2016, the contents of each of which are hereby incorporated by reference in their entirety.

BACKGROUND

U.S. Pat. No. 3,254,828, issued Jun. 7, 1966, to Hershey Lerner under the title Flexible Container Strips is directed to so called bags on a roll (here the AutoBag patent). U.S. Pat. No. 3,254,828 is incorporated herein by reference in its entirety. This patent discloses a web of bags interconnected by lines of weakness, preferably in the form of perforations, with each of the bags being open on one face. In use the bags are sequentially fed to a loading station. When at the loading station, each bag is blown open, a product is inserted and thereafter separated from the web and, if desired, the bag is then sealed to form a package.

These container strips in the form of chains of pre-opened bags are supplied either on a roll as taught in the AutoBag patent or festooned in a carton in the manner taught in U.S. Pat. No. 4,201,029, issued May 6, 1980, to Bernard Lerner et al. under the title Method and Apparatus for Packaging, (herein the Wig-Wag patent). Such container strips have been sold by Automated Packaging Systems, Inc. of Streetsboro, Ohio, the assignee of the present case, under the trademark AutoBag and have enjoyed great commercial success.

SUMMARY

An exemplary apparatus for making packages from a web of interconnected bags includes an indexing mechanism, an opening arrangement, a pair of engagement devices, and a sealing arrangement. The indexing mechanism is configured to move the web of interconnected bags along a path of travel. The opening arrangement is configured to open a bag such that an opening is formed in the bag and a product can be placed into the opening of the bag. The pair of engagement devices are configured to engage the bag and close the opening of the bag. Each engagement device includes a base member, a first link, a second link, a sliding pivot member, and a finger. The first link is pivotably connected to the base member, and the second link is pivotably connected to the first link. The sliding pivot member is configured to allow the second link to slide through the sliding pivot member and pivot in relation to the base member. The finger is connected to the second link. The pair of engagement devices are configured to pull a first side and a second side of the bag in opposite directions. The sealing arrangement is configured to seal the opening of the bag.

Another exemplary apparatus for making packages from a web of interconnected bags includes an indexing mechanism, an opening arrangement, an engagement arrangement, and a sealing arrangement. The indexing mechanism is configured to move the web of interconnected bags along a path of travel. The opening arrangement is configured to open a bag such that an opening is formed in the bag and a product can be placed into the opening of the bag. The engagement arrangement has a left engagement device and a right engagement device. The left engagement device has a left base member, a left first link, a left second link, a left sliding member, and a left finger. The left first link is pivotably connected to the left base member, and the left second link is pivotably connected to the left first link. The left second link is slidably connected to the left sliding member, and the left finger is connected to the left second link. The right engagement device has a right base member, a right first link, a right second link, a right sliding member, and a right finger. The right first link is pivotably connected to the right base member, and the right second link is pivotably connected to the right first link. The right second link is slidably connected to the right sliding member, and the right finger is connected to the right sliding link. The sealing arrangement is configured to seal the opening of the bag.

An exemplary method for making packages from a web of interconnected bags includes advancing the web of interconnected bags along a path of travel and opening a bag of the web such that the bag has an opening. In addition, the method includes placing a product into the opening of the bag such that the product is disposed in an interior of the bag. Subsequently, the method includes closing the opening of the bag with a first engagement device and a second engagement device. The first engagement device has a first finger that moves downward to enter the bag and then pulls a first side of the bag in a direction substantially opposite from a second side of the bag. The second engagement device has a second finger that moves downward to enter the bag and then pulls the second side of the bag in a direction substantially opposite from the first side of the bag. The method further includes sealing the opening of the bag with the product disposed in the interior of the bag.

BRIEF DESCRIPTION OF THE DRAWING

These and other features and advantages of the present invention will become better understood with regard to the following description and accompanying drawings in which.

DETAILED DESCRIPTION

Figure 14:
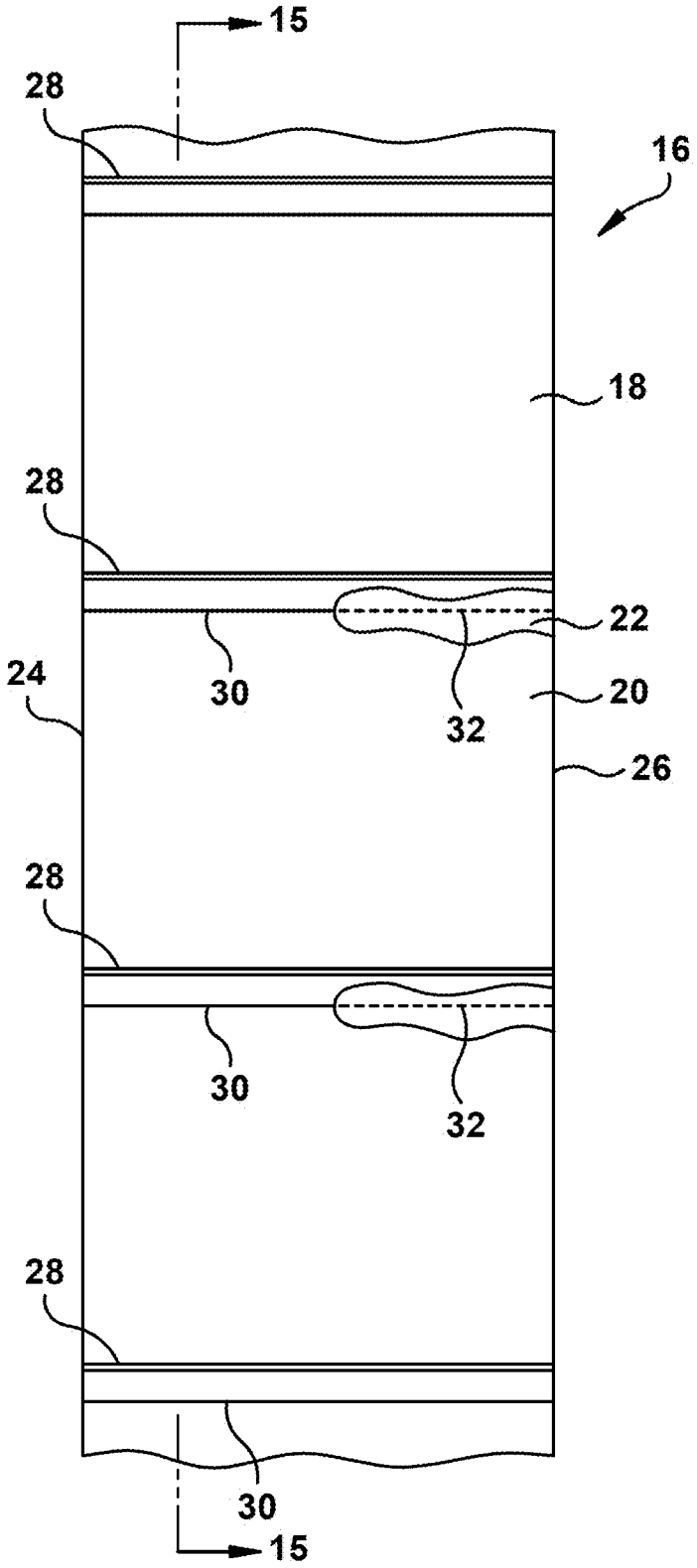
FIG. 14 is a view, partially cut away, of an elongated web of bags.
Figure 15:
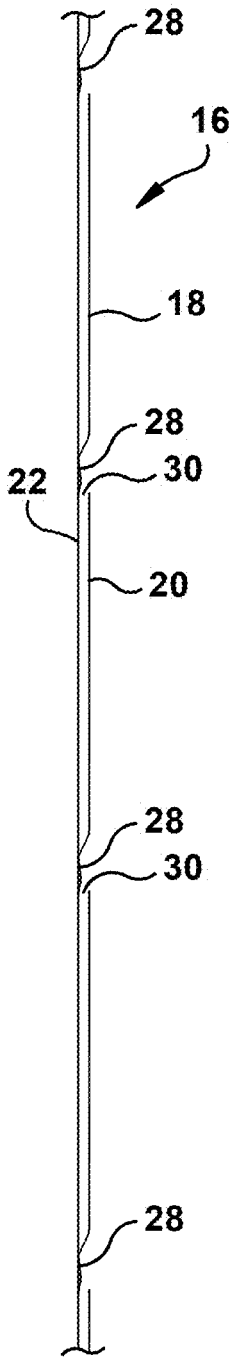
FIG. 15 is a sectional view taken along the plane indicated by lines 15-15 in FIG. 14.

The present application relates to elongated webs 16 of preformed interconnected bags 18 and machines for loading and sealing the bags to make packages. Referring to FIGS. 14 and 15, the web 16 has an opening 30 defined in a first ply 20 and a line of separation 32 in a second ply 22. The webs 16 of preformed interconnected bags 18 can take a wide variety of different forms. In the exemplary embodiments illustrated by FIGS. 14 and 15, each preformed bag 18 is defined by first and second plies 20, 22 of the web 16. First and second side edges 24, 26 of the web hermetically join the first and second plies. Preformed seals 28 extend between the first and second side edges 24, 26. The opening 30 extends between the first and second side edges 24, 26. The line of separation 32, such as a line of perforations in the second ply 22 extends between the first and second side edges 24, 26. In one exemplary embodiment, the opening 30 is superposed over the line of perforations 32. In another exemplary embodiment, the opening 30 and the line of perforations 32 are offset.

The web 16 of preformed bags 18 illustrated by FIGS. 14 and 15 is one example of the wide variety of different webs that may be used. Examples of acceptable webs of preformed interconnected bags include, but are not limited to, the webs disclosed in U.S. Pat. No. 3,254,828 to H. Lerner and U.S. Pat. No. 5,957,824 to B. Lerner et al., which are incorporated herein by reference in their entirety.

The web 16 may be formed of any suitable material. Examples of suitable materials include, but are not limited to, plastic materials, polyethylene, cellophane, vinyl films, pliofilms, cellulose acetate film, polystyrene, polypropylene, and any heat sealable material.

Figure 17:
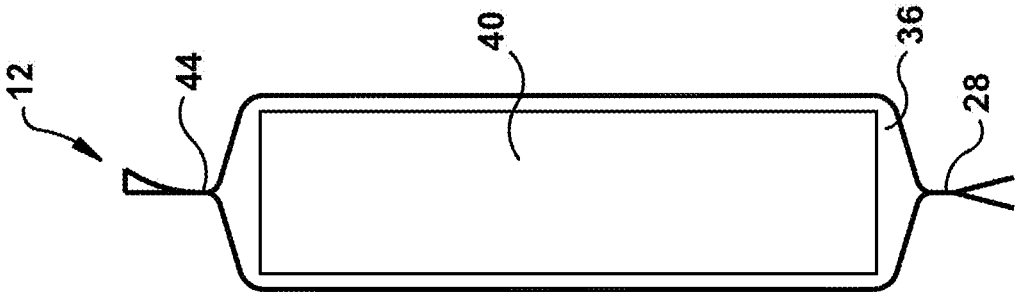
FIG. 17 is a view taken along the plane indicated by lines 17-17 in FIG. 16.
Figure 16:
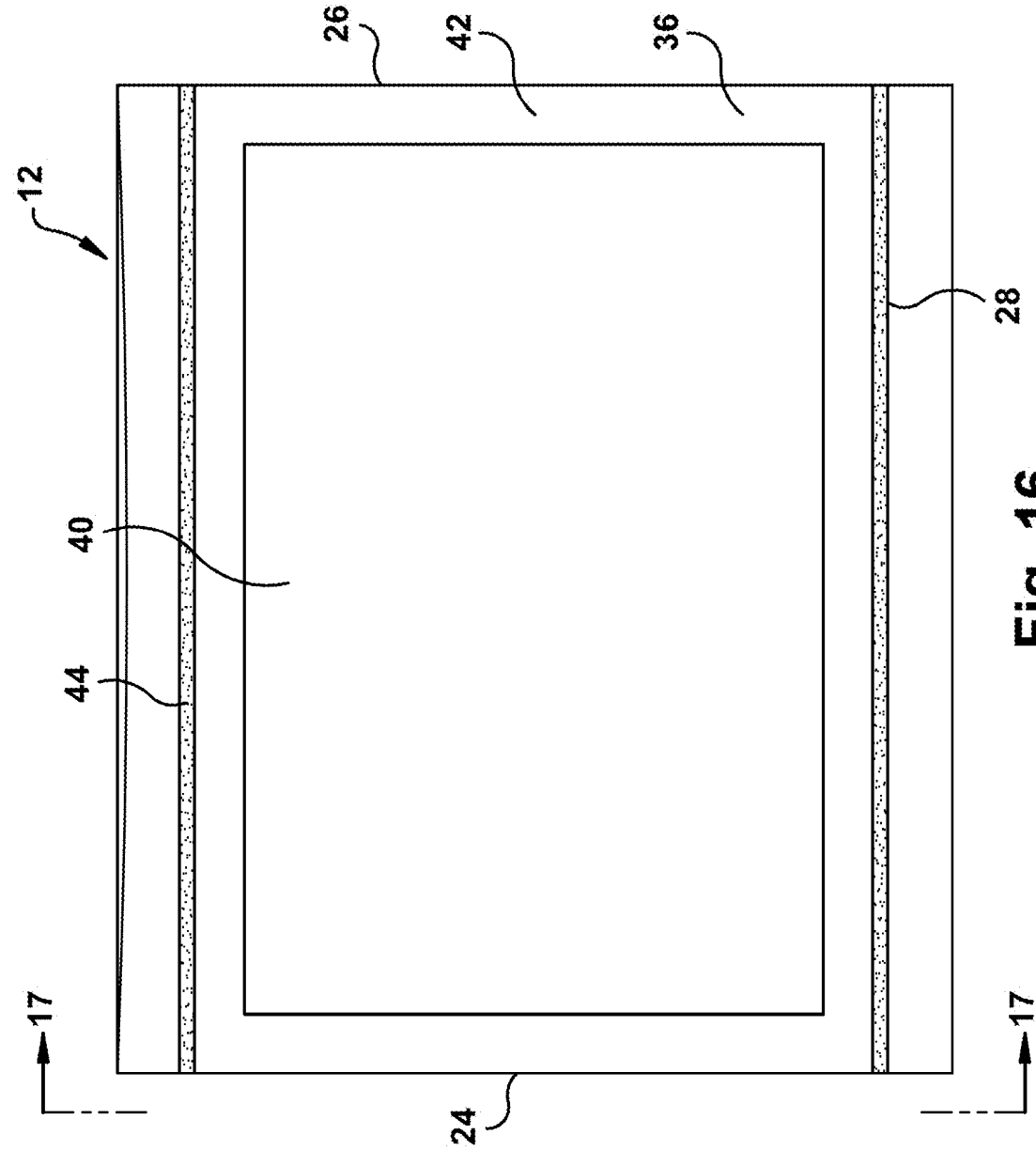
FIG. 16 is a front view of an exemplary embodiment of a package.

Referring to FIGS. 16 and 17, an exemplary package 12 includes a sealed compartment 36. The package 12 may have any number of compartments. Product 40 is disposed in the compartment 36. The illustrated product 40 is a box. However, the package 12 may contain any product. The compartment is defined by the first and second side edges 24, 26, the preformed seal 28, and a seal 44 that is formed after the product 40 is loaded into the bag. In the example, the seal 44 extends from the first side edge 24 to the second side edge 26 to hermetically seal the compartment 36. In another embodiment, the dividing seal 28 may not extend all the way from the first side edge to the second side edge or may be intermittent to allow communication between the compartment 44 and external air or the compartment 44 and another optional compartment of the package. The webs 18 of interconnected bags 16 can be made in a wide variety of different ways.

Figure 1C:
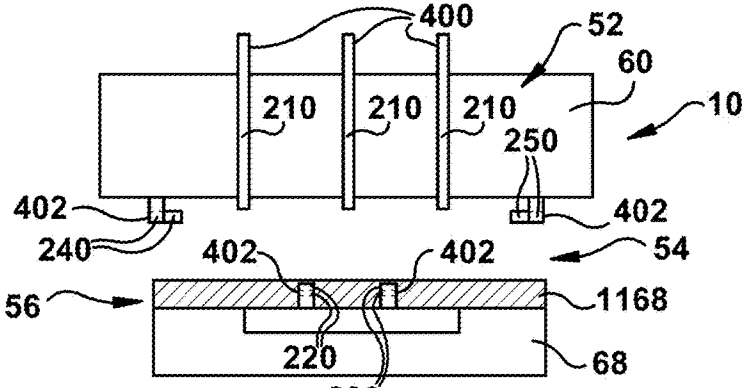
FIG. 1C is a top view of the apparatus shown in FIG. 1A.
Figure 1A:
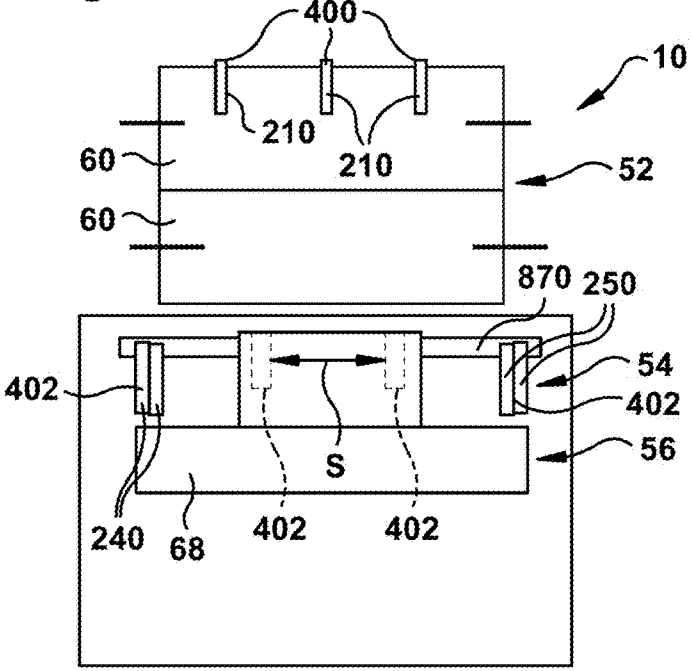
FIG. 1A is a front view of an exemplary apparatus for making packages from an elongated web of preformed interconnected bags.
Figure 1B:
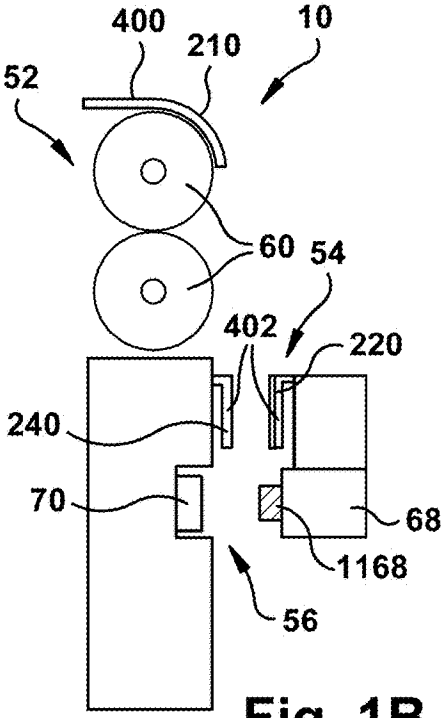
FIG. 1B is a side view of the apparatus shown in FIG. 1A.

The webs 18 of interconnected bags 16 can be used in a wide variety of different applications. For example, the webs 18 of interconnected bags 16 can be used in a wide variety of different packaging machines. FIGS. 1A-1C illustrate an exemplary embodiment of an apparatus 10 or packaging machine for making packages 12 from an elongated web 16 of preformed interconnected bags 18, such as the elongated webs 16 of bags 18 illustrated by FIGS. 14 and 15.

FIGS. 1A-1C through 13A-13C schematically illustrate an exemplary machine being operated to make packages 12 from an elongated web 16 of preformed interconnected bags 18. Any apparatus represented by the schematic illustrations of 1A-1C through 13A-13C can be used that performs the functions shown by FIGS. 1A-1C through 13A-13C. The concepts of the apparatus 10 can be implemented in any of a wide variety of packaging machines. For example, U.S. Pat. No. 3,254,468 to H. Lerner, U.S. Pat. No. 4,928,455 to Gereby et al., U.S. Pat. No. 5,341,625 to Kramer, U.S. Pat. No. 5,394,676 to B. Lerner et al., U.S. Pat. No. 6,543,201 to Cronauer et al., U.S. Pat. Nos. 6,742,317, 5,394,676, 5,371,521, and 4,899,520 disclose packaging machines that can be modified in accordance with the present invention to make packages from an elongated web of preformed interconnected bags and are all incorporated herein by reference in their entirety.

Figure 2C:
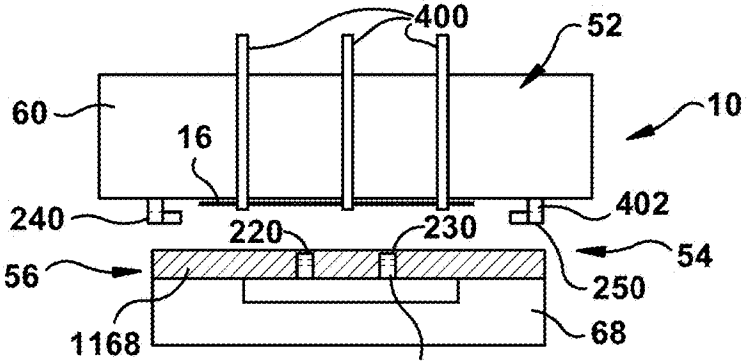
FIG. 2C is a top view of the apparatus and elongated web shown in FIG. 2A.
Figure 2A:
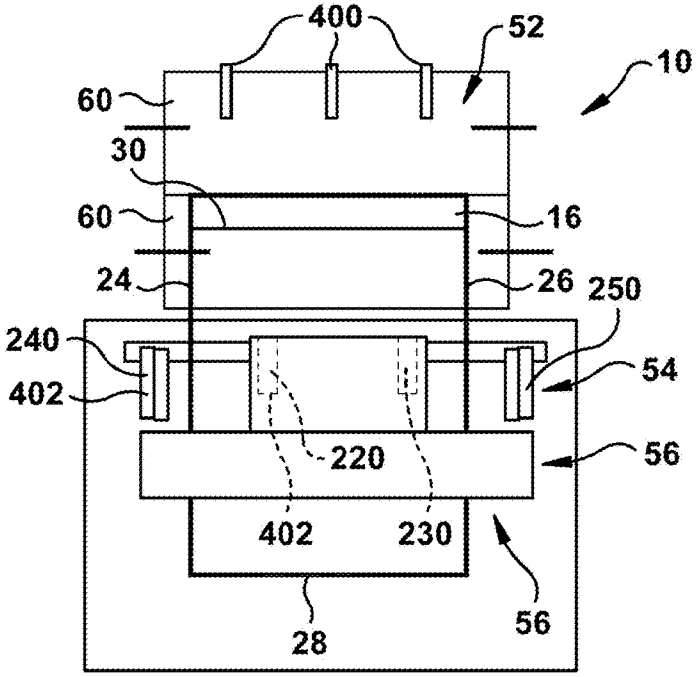
FIG. 2A is a front view of the apparatus showing the elongated web being advanced through the apparatus.
Figure 2B:
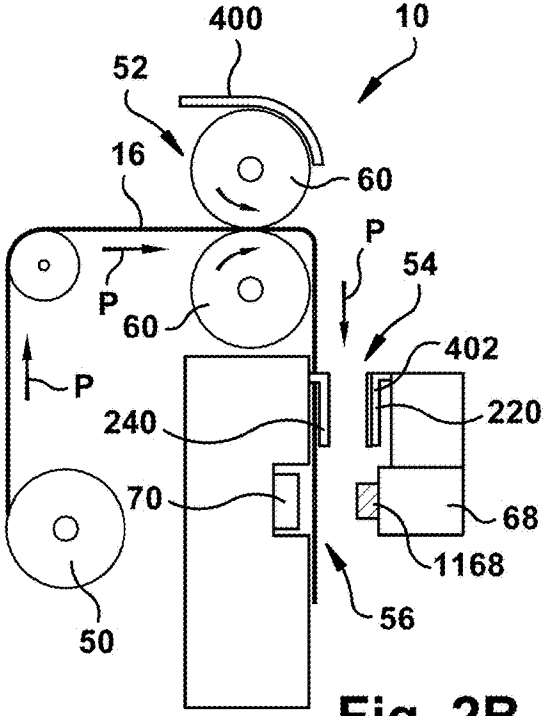
FIG. 2B is a side view of the apparatus and elongated web shown in FIG. 2A.
Figure 3C:
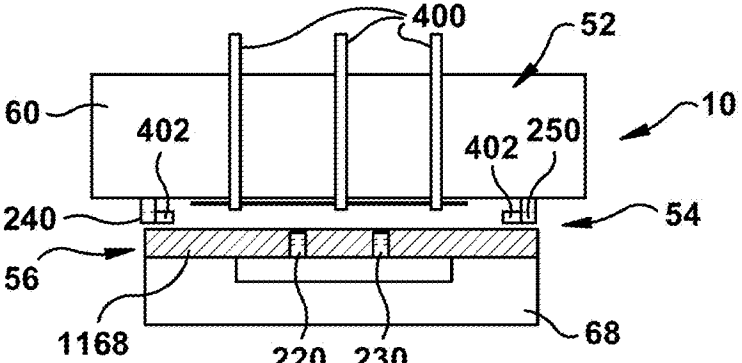
FIG. 3C is a top view of the apparatus and elongated web shown in FIG. 3A.
Figure 3A:
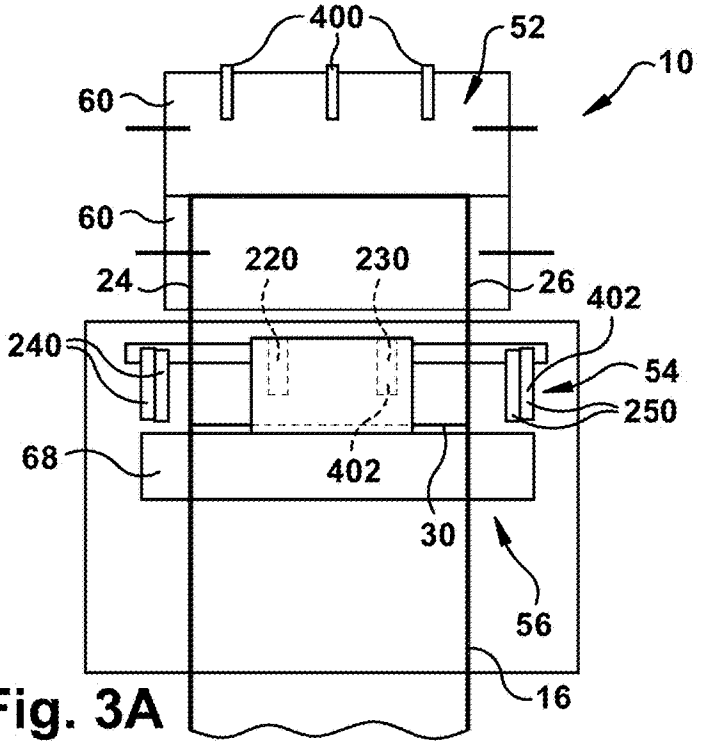
FIG. 3A is a front view of the apparatus showing the elongated web opening being positioned below a bag opening arrangement of the apparatus.
Figure 3B:
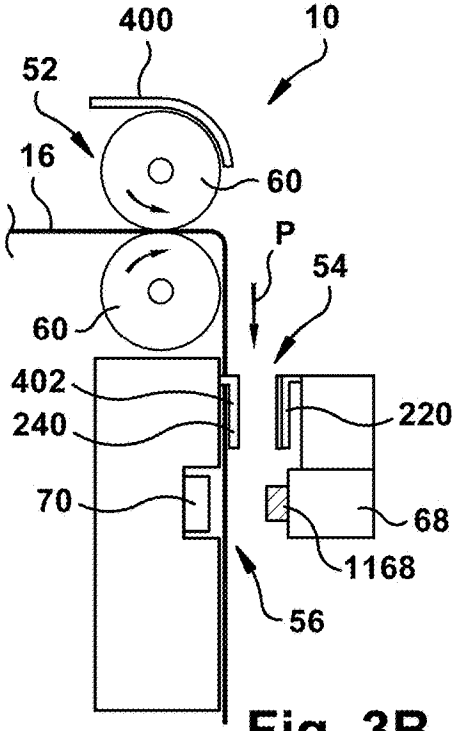
FIG. 3B is a side view of the apparatus and elongated web shown in FIG. 3A.

Referring now to FIGS. 1A-1C, the illustrated apparatus 10 includes a supply 50 (FIG. 2B) of the elongated web 16 of preformed interconnected bags 18, an indexing mechanism 52, an opening arrangement 54, a sealing arrangement 56, and a controller (not shown). The supply 50 comprises the elongated web 16 that is rolled or folded to stage a relatively large amount of the web in a relatively small space. The web 16 is routed from the supply 50 along a path of travel P to the indexing mechanism 52. The indexing mechanism 52 receives the web 16 from the supply and moves the web along the path of travel P. The indexing mechanism 52 may take a wide variety of different forms. For example, any indexing mechanism that can be controlled to index bags of the web to selected positions along the path of travel may be used. In the illustrated example, the indexing mechanism comprises a pair of rollers 60 that form a nip that engages the web 16. The rollers 60 are selectively driven by a motor (not shown) to index bags of the web to selected positions along the path of travel P.

Referring to FIGS. 1A-1C, the opening arrangement 54 is positioned along the path of travel P to open each bag that is to be loaded and sealed. In the illustrated embodiment, the opening arrangement 54 comprises a blower 400 and an engagement device 402. However, the opening arrangement 54 may take a wide variety of different forms. The blower 400 can take a wide variety of different forms. In the illustrated embodiment, the blower 400 comprises a plurality of nozzles 210 positioned above the rollers 60 of the indexing mechanism 52. The illustrated nozzles 210 are oriented downward to blow air downward past the rollers 60 along the path of travel P of the web 18.

The engagement device 402 can take a wide variety of different forms. In the illustrated embodiment, the engagement device 402 comprises a first pair of grippers 220 and a second pair of grippers 230. The first pair of grippers 220 are spaced apart from the second pair of grippers 230 and both are configured to grip the first ply 20 of the bag 16. In one exemplary embodiment, the spacing S (FIG. 1A) between the grippers 220, 230 is adjustable. This optional spacing may be automatic and controlled by the controller or the spacing may be manually adjusted. This allows the engagement device to provide openings 800 (See FIG. 8) having different widths.

The engagement device 402 also includes a third pair of grippers 240 and a fourth pair of grippers 250. The third pair of grippers 240 and the fourth pair of grippers 250 are moveable relative to one another and are configured to grip the side edges 24, 26 of the bag 18. The third and fourth pairs of grippers 240, 250 are omitted from FIGS. 11B, 12B, and 13B to more clearly illustrate opening of the first and second pairs of grippers 220, 230.

The grippers 220 and 230 grip the opening 30 and move to create the rectangular opening 800 as will be described in more detail below. This rectangular opening allows the large items, such as rectangular items, like boxes to be packaged inside the bag 18. While the opening 800 is shown as a rectangular shape, the opening can be any shape. For example, the opening could be a quadrilateral, a trapezoid, a triangle, or any other shape. The number of grippers used to grip the opening 30 of the bag may be increased or decreased to create the desired opening shape. Different shape openings accommodate different shape packages being inserted into the bags.

Referring to FIGS. 1A-1C, the controller is in communication with the indexing arrangement 52, the opening arrangement 54, and the sealing arrangement 56. The controller controls the indexing arrangement 52, the opening arrangement 54, and the sealing arrangement 56 to convert the preformed bags 18 into packages 12. A wide variety of controllers can be used and programmed to control the indexing arrangement 52, the opening arrangement 54, and the sealing arrangement 56 as described herein. For example, the controller and controller algorithms described in U.S. Pat. No. 5,341,625 to Kramer can be modified to control the indexing arrangement 52, the opening arrangement 54, and the sealing arrangement 56 to form the packages.

Referring to FIGS. 2A-2C and 3A-3C, the controller controls the indexing mechanism 52 to index the web 16 forward along the path of travel as indicated by arrows P, until the opening 30 of the bag 18 is just below the engagement device 402 in the exemplary embodiment. In alternate embodiments, the opening 30 is indexed to other positions. For example, the opening 30 can be indexed to any position where the blower 400 can blow the opening 30 open or at least partially open. For example, the opening 30 may initially be positioned above the engagement device 402, be blown open by the blower 400, and then be moved to the position illustrated by FIGS. 3A-3C.

Figure 4C:
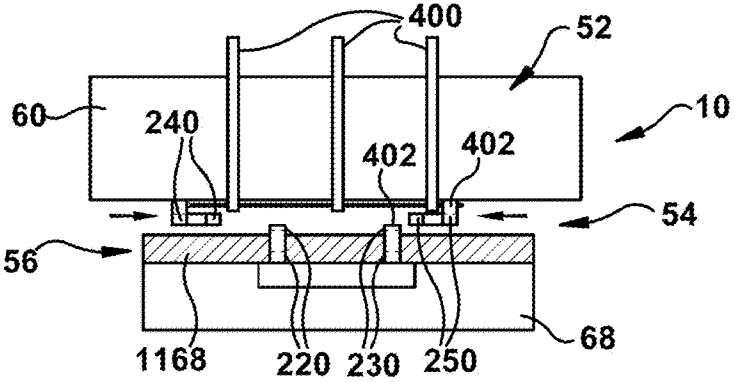
FIG. 4C is a top view of the apparatus and elongated web shown in FIG. 4A.
Figure 4A:
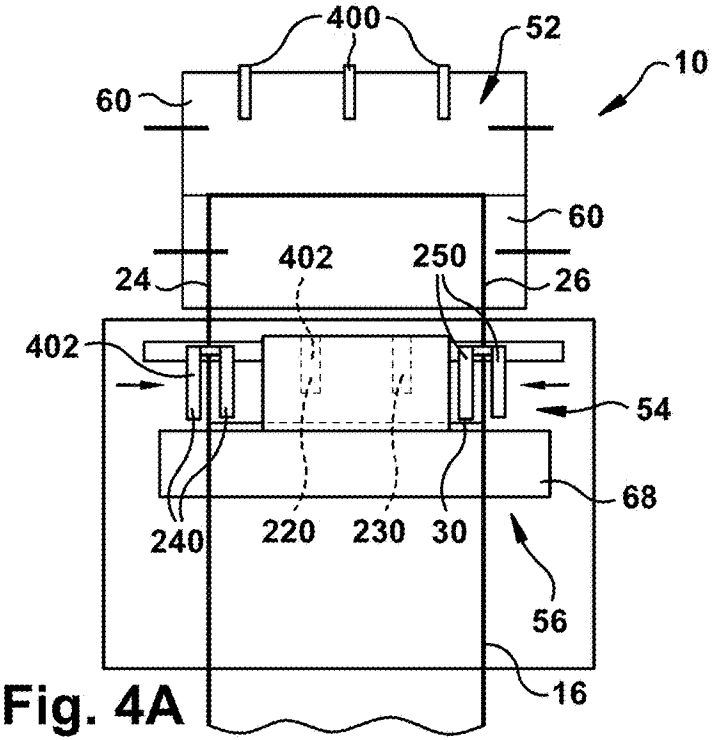
FIG. 4A is a front view of the apparatus showing bag engagement devices moved into position above the elongated web opening.
Figure 4B:
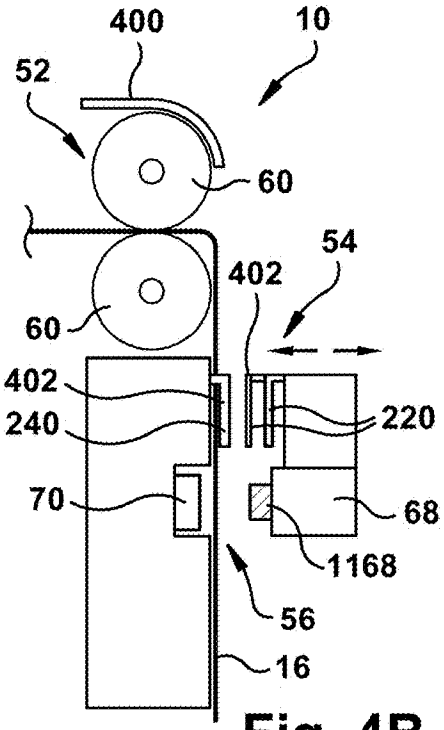
FIG. 4B is a side view of the apparatus and elongated web shown in FIG. 4A.
Figure 5C:
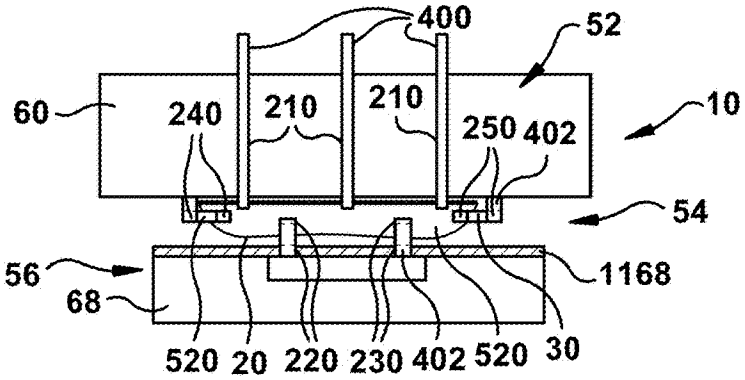
FIG. 5C is a top view of the apparatus and elongated web shown in FIG. 5A.
Figure 5A:
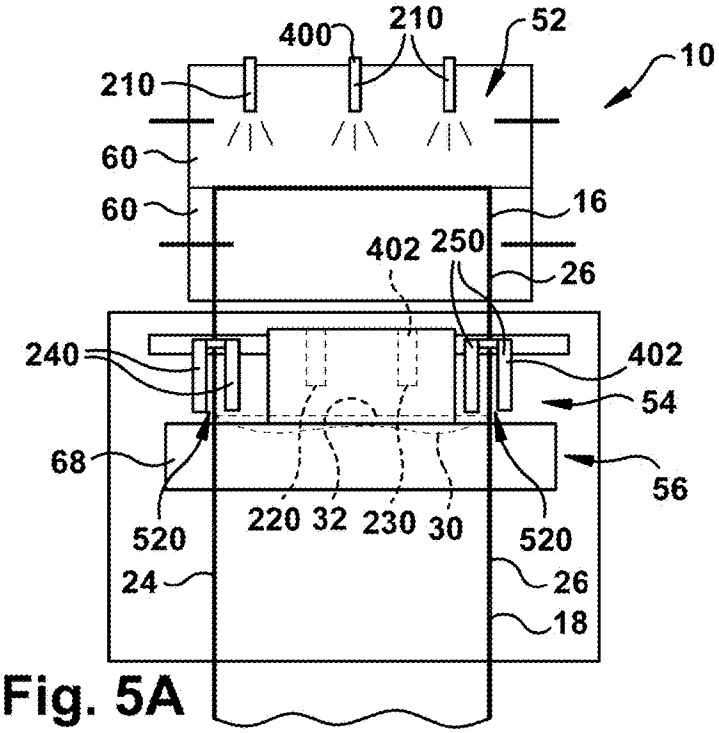
FIG. 5A is a front view of the apparatus showing the web opening being blown open above the bag engagement devices.
Figure 5B:
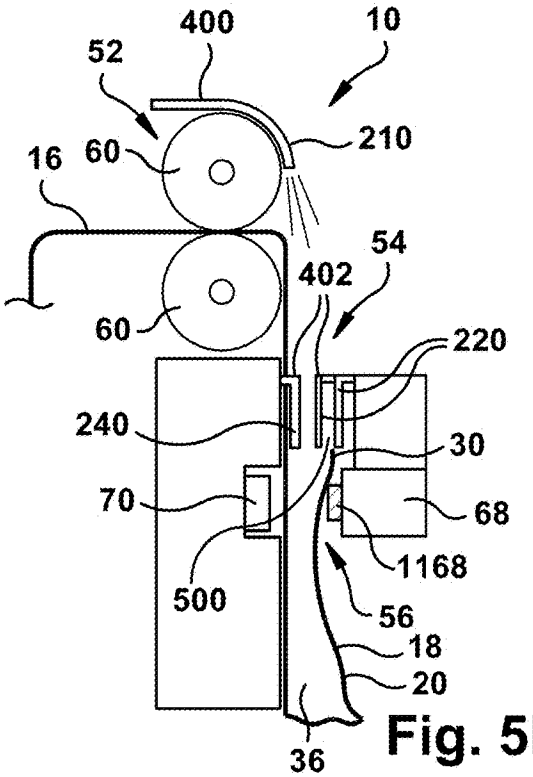
FIG. 5B is a side view of the apparatus and elongated web shown in FIG. 5A.

In an exemplary embodiment, the controller controls the engagement device to move the grippers 220, 230, 240, 250 from a closed position (See FIGS. 3A-3C) to an open position (See FIG. 4A-4C) once the opening 30 is positioned below the engagement device 402. Referring to FIGS. 5A-5C, the controller controls the blower 400 to blow air between the plies 20, 22 at the opening 30 of the bag. The air is forced between the plies through the opening 30 to inflate the bag 18. In an exemplary embodiment, the first ply 20 of the inflated bag 18 is generally aligned with or aligned with a gap 500 (see FIG. 5B) between the gripping members of each pair of open gripper 220, 230. In an exemplary embodiment, the edges of the inflated bag 18 are generally aligned with or aligned with a gap 520 (see FIGS. 5A and 5C) between the gripping members of each open pair of grippers 240, 250. In another embodiment, the bag 18 is not inflated but opened by other means just enough to allow the grippers 220, 230, 240, 250 to be inserted into the opening 30 of the bag.

Figure 6C:
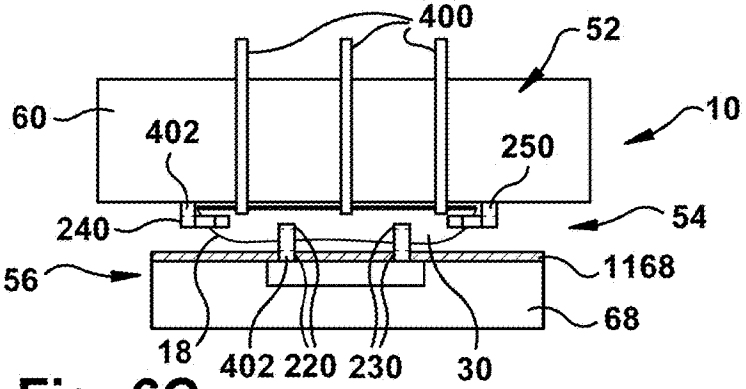
FIG. 6C is a top view of the apparatus and elongated web shown in FIG. 6A.
Figure 6A:
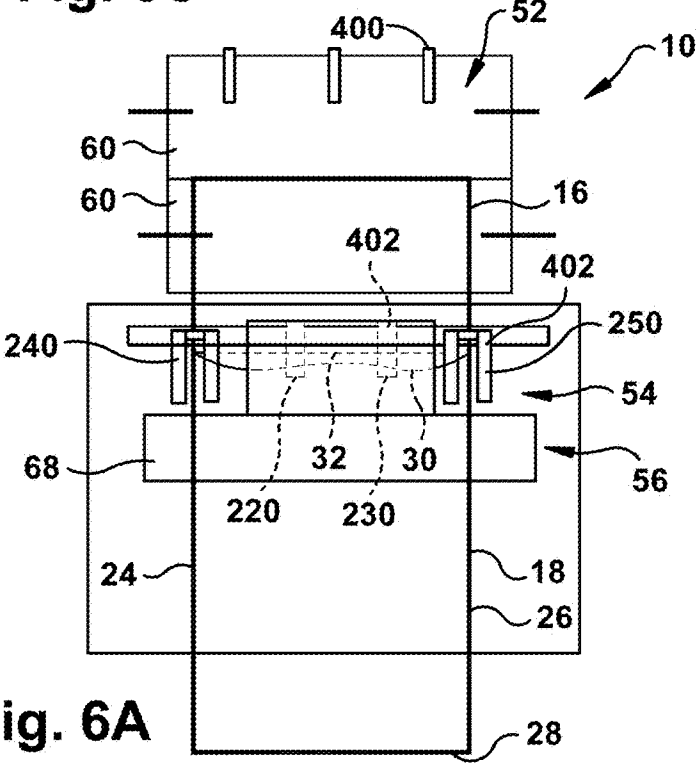
FIG. 6A is a front view of the apparatus showing the web being reverse indexed to position the bag engagement devices inside the web opening.
Figure 6B:
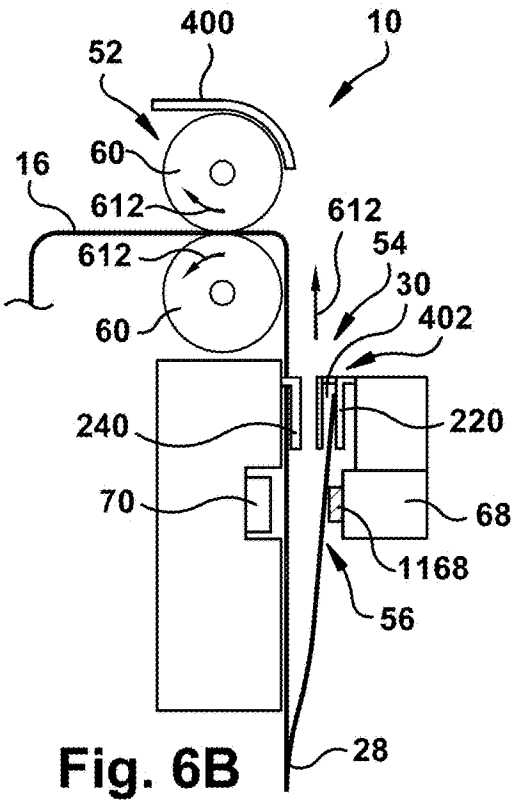
FIG. 6B is a side view of the apparatus and elongated web shown in FIG. 6A.

Referring to FIGS. 6A-6C, in an exemplary embodiment the controller 58 causes the indexing mechanism 52 to reverse index the web as indicated by arrow 612 while the pairs of grippers 220, 230 are open. The blower 400 may optionally be stopped during the reverse indexing. The reverse indexing pulls the first ply 20 of the bag 18 into the gap 500 between the gripping members of each pair of open grippers 220, 230. The reverse indexing also pulls the edges 24, 26 of the bag 18 into the gap 520 between the gripping members of each pair of open grippers 240, 250.

Figure 7C:
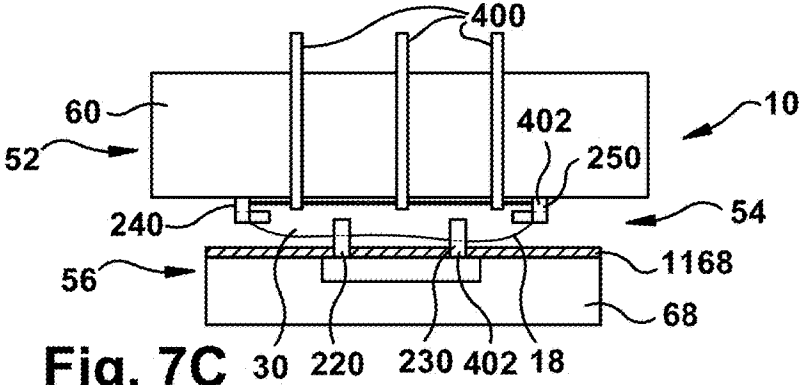
FIG. 7C is a top view of the apparatus and elongated web shown in FIG. 7A.
Figure 7A:
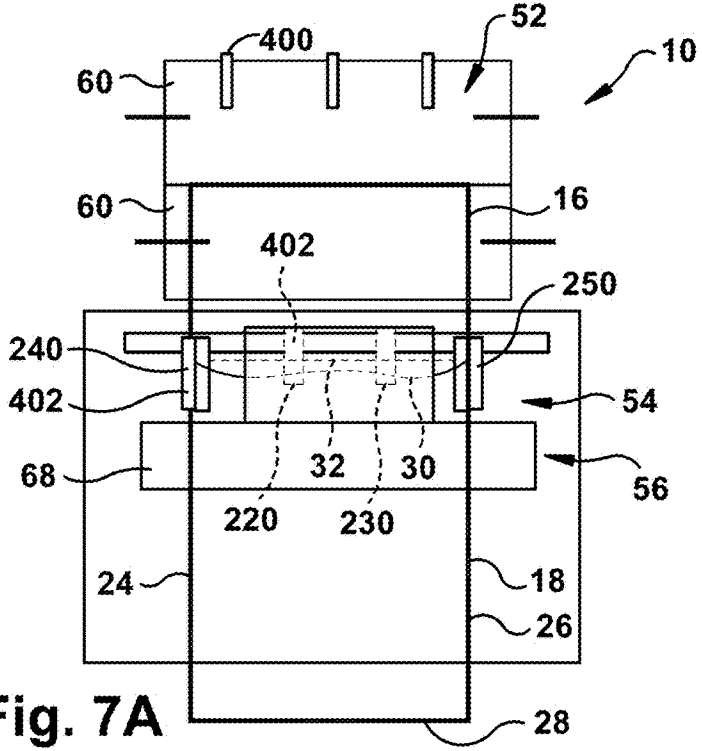
FIG. 7A is a front view of the apparatus showing bag engagement devices engaging a bag of the web at the opening.
Figure 7B:
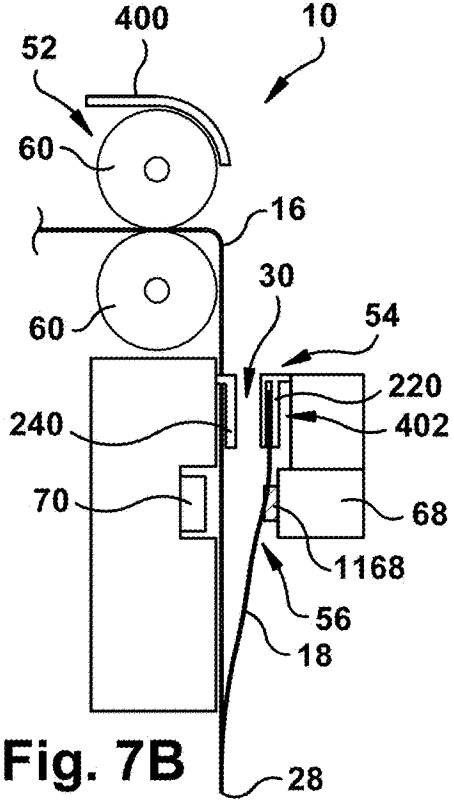
FIG. 7B is a side view of the apparatus and elongated web shown in FIG. 7A.

Referring to FIGS. 7A-7C, in an exemplary embodiment the controller 58 causes the pairs of grippers 220, 230, 240, 250 to move from the open position to the closed position. The first ply 20 of the bag 18 is gripped between the gripping members of each of the pairs of gripper 220, 230. The edges 24, 26 of the bag 18 are gripped between the gripping members of each pair of grippers 240, 250.

Figure 8C:
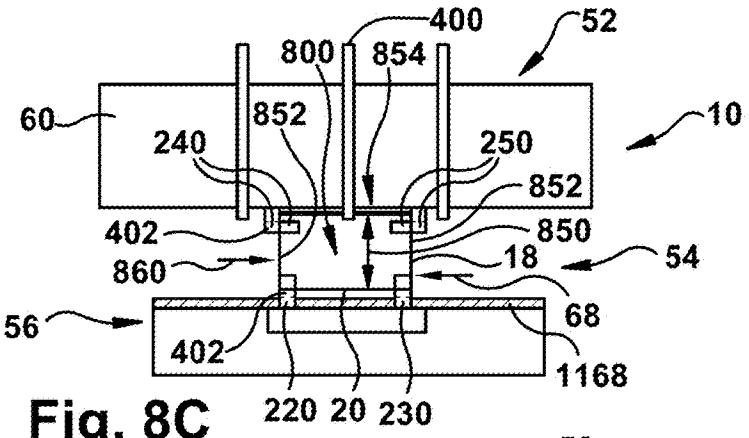
FIG. 8C is a top view of the apparatus and elongated web shown in FIG. 8A.
Figure 8A:
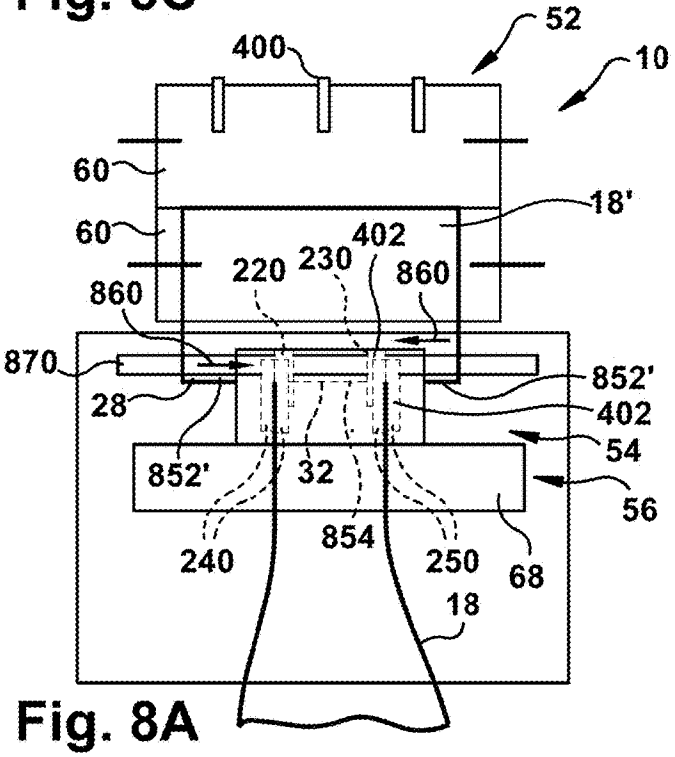
FIG. 8A is a front view of the apparatus showing the engagement devices moving to provide a rectangular bag opening.
Figure 8B:
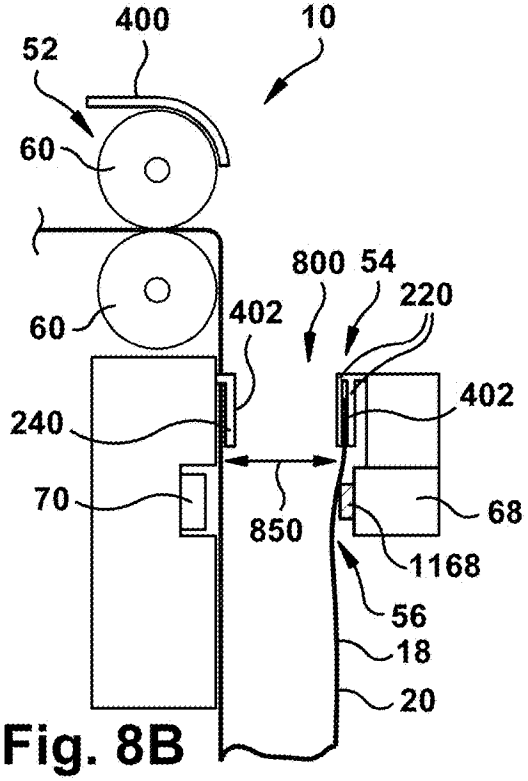
FIG. 8B is a side view of the apparatus and elongated web shown in FIG. 8A.
Figure 9C:
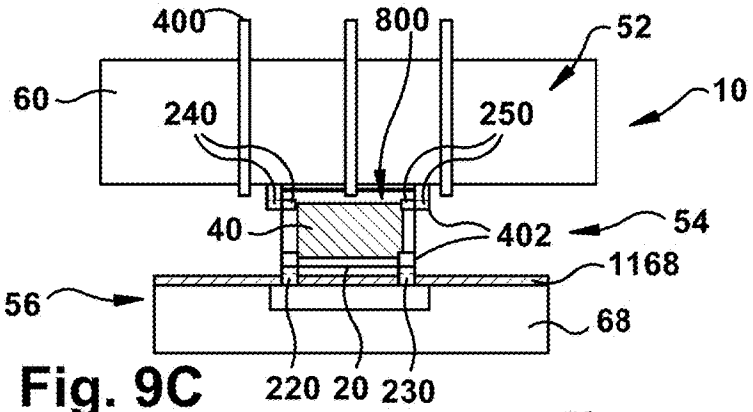
FIG. 9C is a top view of the apparatus and elongated web shown in FIG. 9A.
Figure 9A:
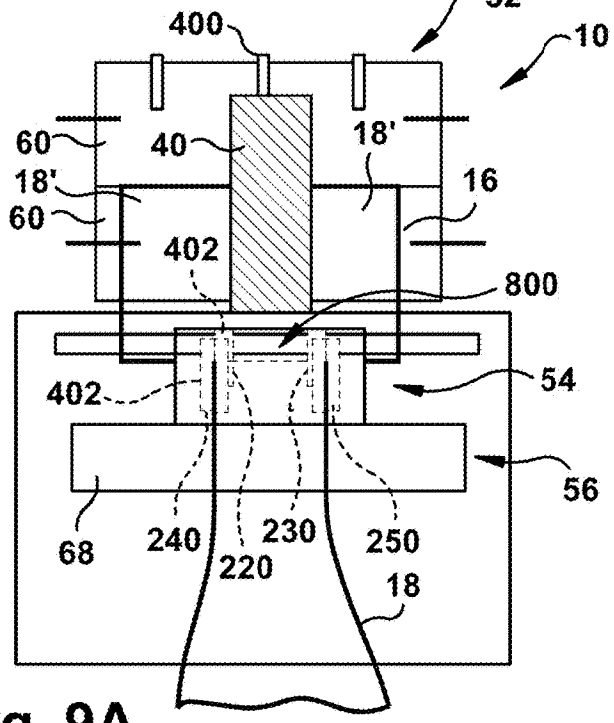
FIG. 9A is a front view of the apparatus showing a rectangular product positioned above the rectangular bag opening.
Figure 9B:
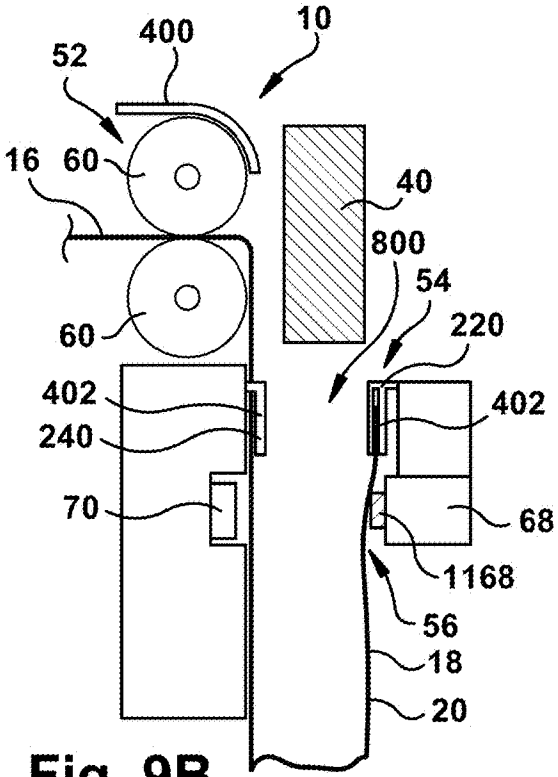
FIG. 9B is a side view of the apparatus and elongated web shown in FIG. 9A.
Figure 10C:
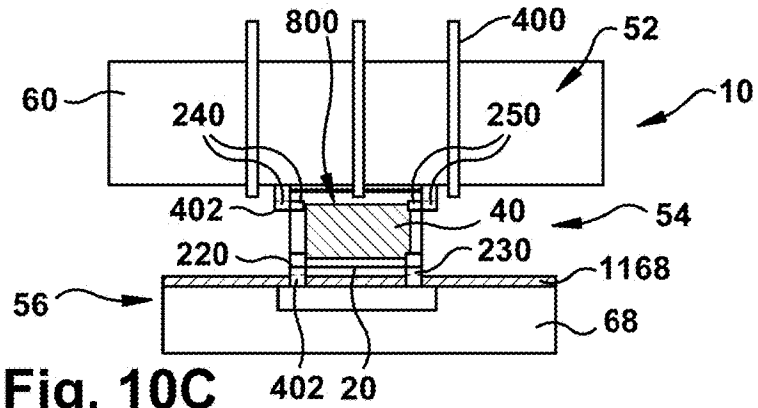
FIG. 10C is a top view of the apparatus and elongated web shown in FIG. 10A.
Figure 10A:
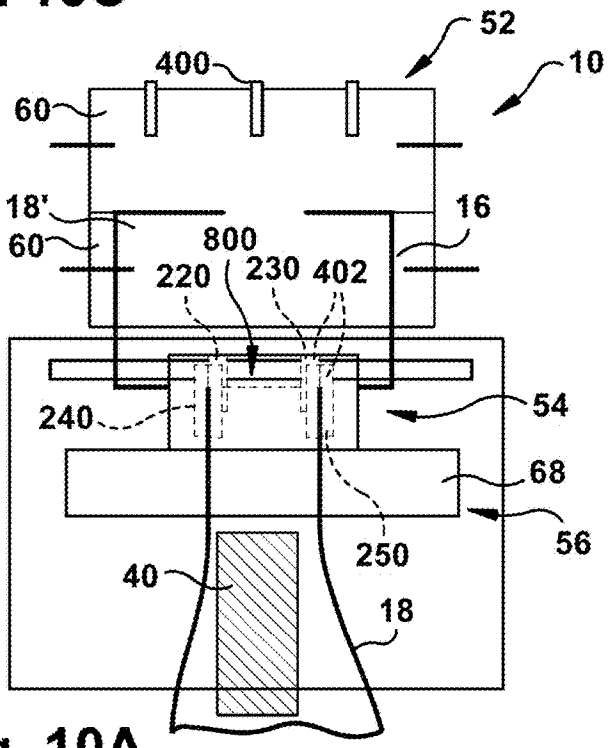
FIG. 10A is a front view of the apparatus showing a rectangular product positioned in the open bag.
Figure 10B:
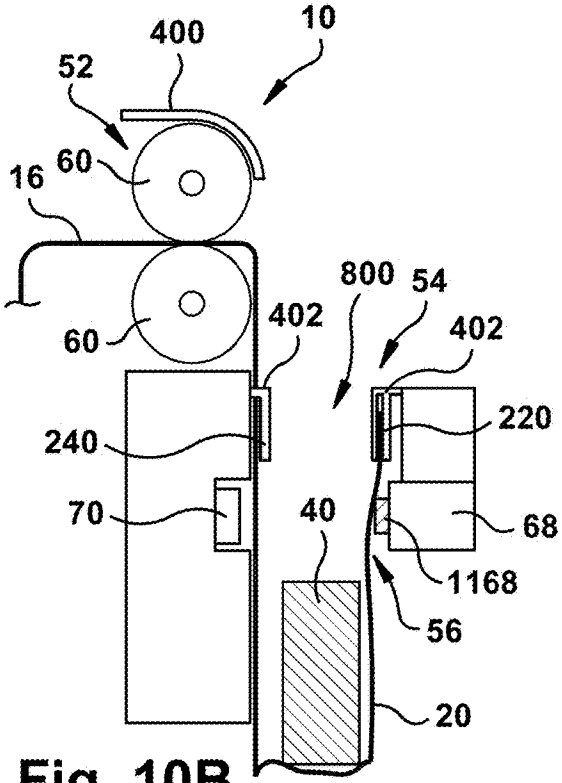
FIG. 10B is a side view of the apparatus and elongated web shown in FIG. 10A.

Referring to FIGS. 8A-8C, each bag 18 is provided with a rectangular opening 800 at a position where the bag is loaded with a product 40. Referring to FIGS. 8A-8C, in an exemplary embodiment, the controller controls the engagement device 402 to provide the bag 18 with the rectangular opening 800 for loading. In the illustrated embodiment, the pairs of gripping members 220, 230 move the first ply 20 away from the second ply 22 as indicated by arrows 850 (see FIGS. 8B and 8C). At the same time, the pairs of gripping members 240, 250 move the edges 24, 26 toward each other as indicated by arrows 860 (see FIGS. 8A and 8C). The movement of the pairs of gripping members 240, 250 tears the line of perforations 32 in the second layer 22. As such, edge portions 852 of the bag 18 are torn away from edge portions 852' of the next bag 18', allowing the rectangular opening 800 to be formed. In one exemplary embodiment, the second ply 22 slides between the pairs of gripping members 240, 250 as the pairs of gripping members 240, 250 move from the position illustrated by FIGS. 7A-7C to the position illustrated by FIGS. 8A-8C. A center portion 854 of the line of perforations 32 in the second layer 22 of the bag 18 remains in-tact. This leaves the bag 18 connected to the bag 18' while the bag 18 has the rectangular opening 800.

The pairs of gripping members 220, 230 can move the first ply 20 away from the second ply 22 in a wide variety of different ways. In the illustrated embodiment, the pairs of gripping members 220, 230 are attached to a bar 68 that is part of the sealing assembly 56. In this embodiment, the bar 68 moves the attached pairs of gripping members 220, 230. However, the pairs of gripping members 220, 230 can be moved by an actuator that is separate from the bar 68. The pairs of gripping members 240, 250 can move the edges 24, 26 toward each other in a variety of different ways. In the illustrated embodiment, the pairs of gripping members 240, 250 move in a slot 870 in a housing of the apparatus 10. The pairs of gripping members 240, 250 can be driven by a motor, a linear actuator or any other mechanism.

Referring to FIGS. 9A-9C and 10A-10C, the bag 18 is maintained with the rectangular opening 800 at the load position and the product 40 is loaded into the bag 18. The product may be loaded manually or automatically. In the illustrated embodiment, the position where the bag 18 is loaded is also the position where bag 18 is sealed after the rectangular opening 800 is closed. In another embodiment, the position where the bag is loaded is different than the position where the bag is sealed. In this embodiment, the controller causes the indexing mechanism 52 to move the bag 18 to the seal position after the bag is loaded with product 40 and closed.

In an exemplary embodiment, once the product is loaded in the bag 18, an operator may provide a signal to the controller that indicates that loading is complete or completion of loading may be automatically detected. The apparatus 10 may be configured to allow the operator to provide the completed loading signal to the controller in a wide variety of different ways. For example, the apparatus may have a control foot pedal (not shown) or the sealing arrangement 56 may have a portion that the operator can push on to indicate that loading is complete and it is time to seal the package. Similarly, the apparatus can be configured to automatically detect completed loading and provide the controller with a signal that indicated this fact. For example, the apparatus may include a counter or may weigh the package to detect completed loading.

Figure 11C:
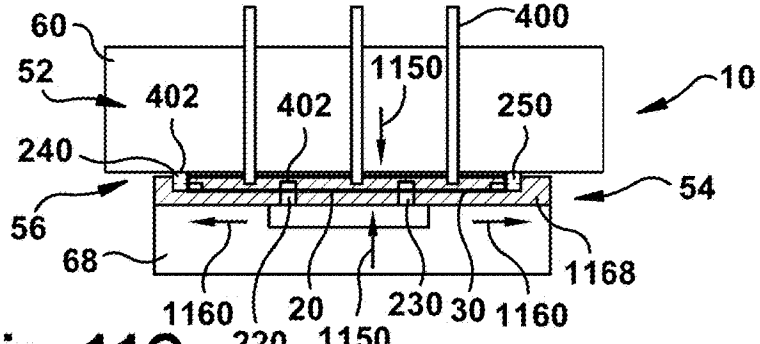
FIG. 11C is a top view of the apparatus and elongated web shown in FIG. 11A.
Figure 11A:
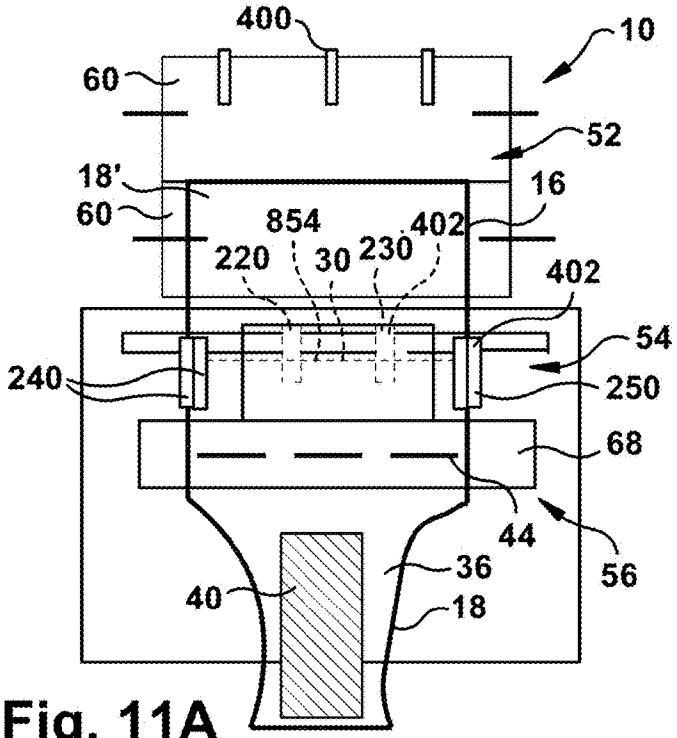
FIG. 11A is a front view of the apparatus showing the bag engagement devices moving to close the bag and the bag being sealed by a sealing arrangement of the apparatus.
Figure 11B:
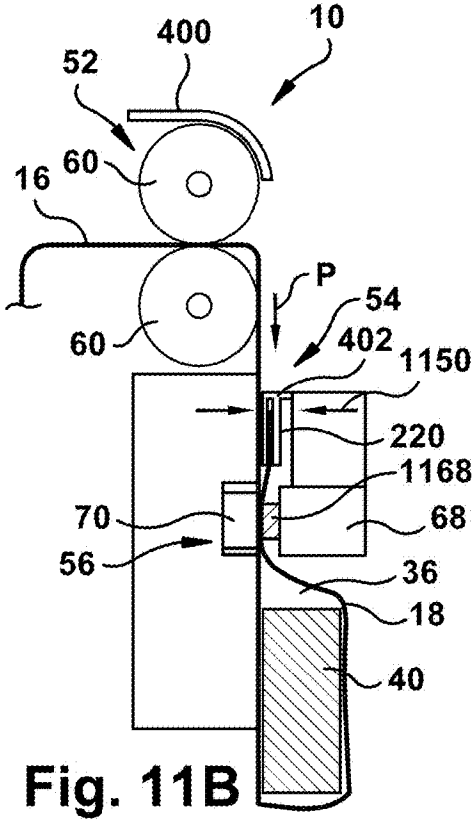
FIG. 11B is a side view of the apparatus and elongated web shown in FIG. 11A.

Referring to FIGS. 11A-11C, the signal from the operator or detection of completed loading is communicated to the controller, and causes the engagement device 402 to close the bag. In the illustrated embodiment, the pairs of gripping members 220, 230 move the first ply 20 back toward the second ply 22 as indicated by arrows 1150 (see FIGS. 11B and 11C). At the same time, the pairs of gripping members 240, 250 move the edges 24, 26 away from each other as indicated by arrows 1160 to close the bag opening 30 (see FIG. 11C). In an exemplary embodiment, the second ply 22 slides through each of the pairs of gripping members 240, 250 as the pairs of gripping members 240, 250 move from the position illustrated by FIGS. 10A-10C to the position illustrated by FIGS. 11A-11C. In the illustrated embodiment, the center portion 854 of the line of perforations 32 in the second layer 22 of the bag 18 remains in-tact. As such, the closed bag 18 remains connected to the bag 18'.

Still referring to FIGS. 11A-11C, the bag may be sealed at the position illustrated by FIGS. 11A-11C or the engagement device 402 may release the bag and the bag may be indexed to another position for sealing. In one exemplary embodiment, the bag is sealed while the engagement device 402 is holding the bag 18 closed. The sealing arrangement 56 is positioned along the path of travel P to provide the seal 44. The sealing arrangement 56 may take a wide variety of different forms. For example, any mechanism that applies heat to the web to seal the first and second webs together to form the seal 44 may be implemented.

In the illustrated embodiment, the sealing arrangement comprises a seal backing bar 68 and a heating element 70 that are that is selectively moved into and out of engagement. Referring to FIG. 11B, when the web is in the seal position, the controller controls the sealing arrangement 56 to clamp the web 16 between the seal backing bar 68 and the heating element 70. In an exemplary embodiment, the seal backing bar 68 comprises a rubber seal backing element 1168. The seal backing bar 68 may be moved to the clamped position (see FIG. 11B) from the unclamped position (See FIG. 10B) under a low force, such as a force that is lower than a force that could injure a finger that might be between the rubber seal backing element 1168 and the heating element 70. In addition, the rubber seal backing element 1168 is not heated.

In an exemplary embodiment, the heating element 70 is moved to the clamped position (See FIG. 11B) from the unclamped position (See FIG. 10B) and/or heat is applied by the heating element 70 only after the rubber seal backing element 1168 has been moved to the clamped position. Heat is applied to the web to seal the plies of the web together between the first side edge 24 and the second side edge 26. The heating element 70 may be continuously on (i.e. always hot when the machine is turned on) or the heating element 70 may be controlled to only apply heat when the bag 18 is clamped and/or a seal signal is provided by the controller. The first and second plies 20, 22 are sealed together to form the compartment 36.

FIGS. 18A-18E illustrate and exemplary embodiment of a sealing assembly 56 that comprises a seal backing bar 68 and a heating element 70 that are that is selectively moved into and out of engagement. In the exemplary embodiment, the heating element 70 is moved by an actuator 1800, such as a pneumatic actuator or a solenoid actuator. The illustrated seal backing bar 68 is moved by a low force actuator 1810 and is held in place by a clamping actuator 1820.

The low force actuator 1810 can take a wide variety of different forms. In one exemplary embodiment, the low force actuator 1810 comprises a servomotor 1812. In the illustrated embodiment, the servomotor 1812 drives a pinion gear 1814 that drives a gear rack 1816. However, any drive arrangement can be employed. In an exemplary embodiment, the low force actuator applies a low force, such as a force that is lower than a force that could injure a person's finger that might be between the seal backing bar 68 and a front panel 1850 of the machine.

The clamping actuator 1820 can take a wide variety of different forms. In one exemplary embodiment, the clamping actuator 1820 is a pneumatic actuator or a solenoid actuator. Any type of actuator can be used. In the illustrated embodiment, the clamping actuator 1820 includes a latch member 1822 for selectively coupling the clamping actuator 1820 to the low force actuator 1810 and decoupling the clamping actuator 1820 from the low force actuator 1810.

Figure 18A:
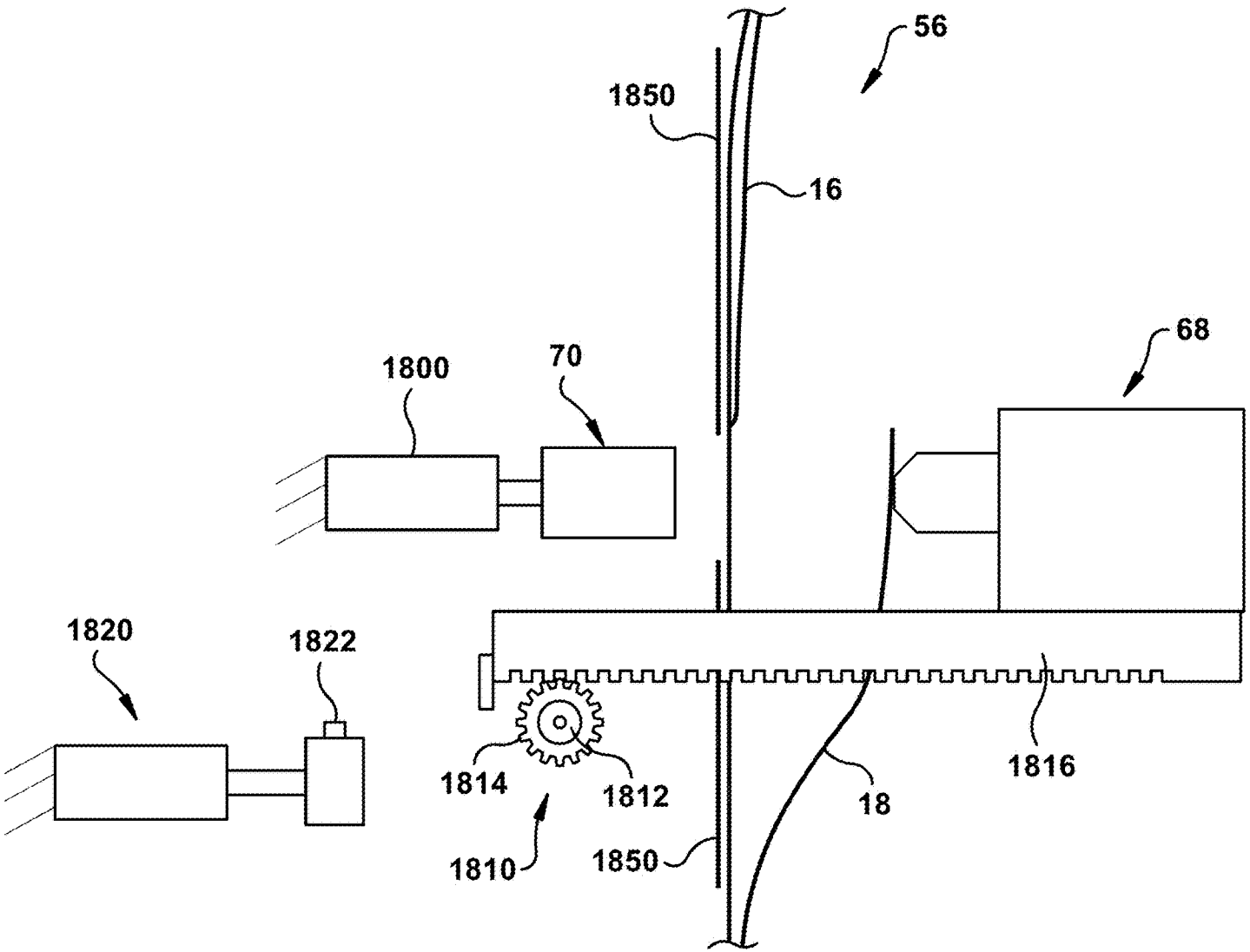
FIGS. 18A-18E illustrate an exemplary embodiment of a sealing assembly.
Figure 18B:
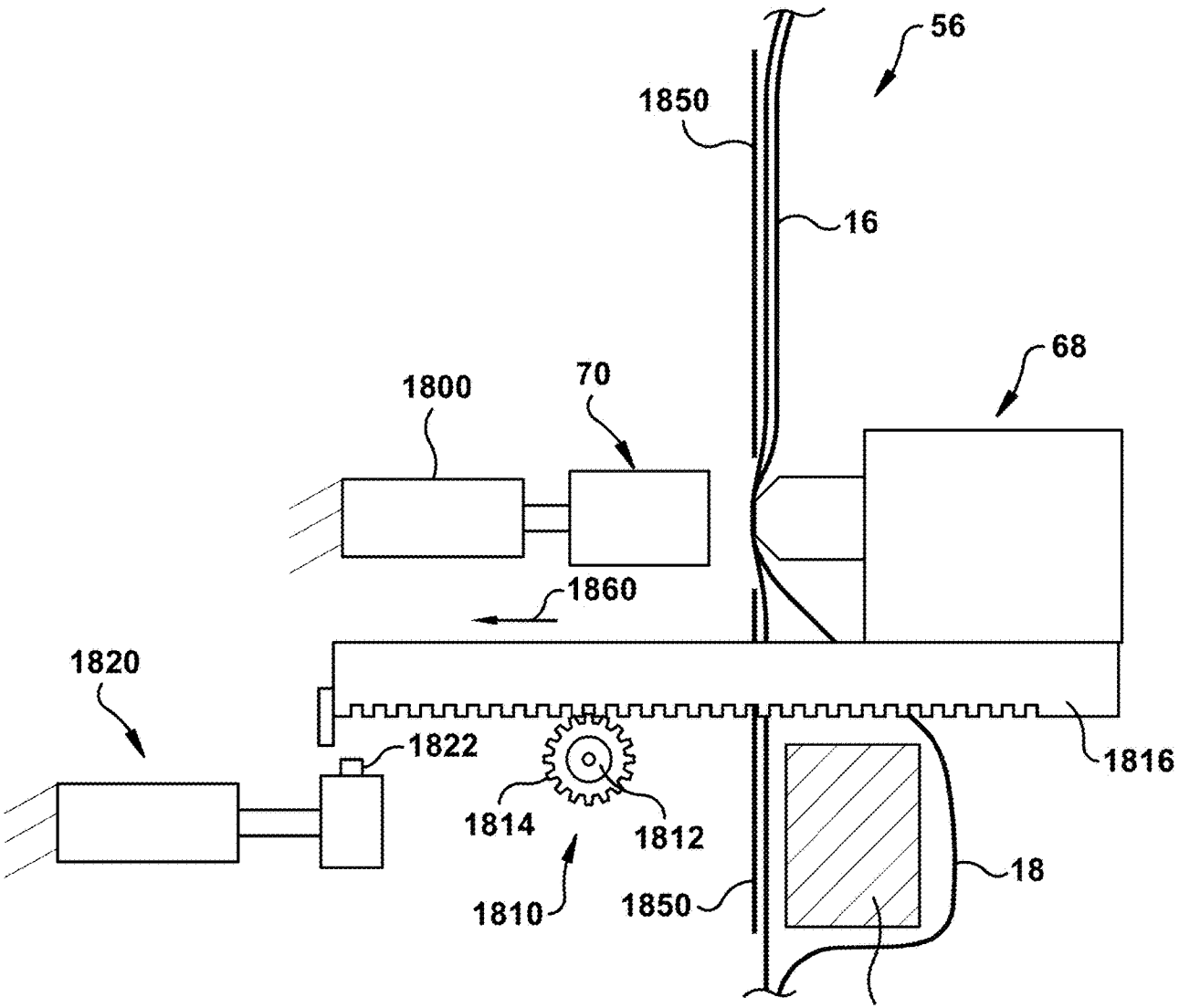
Figure 18C:
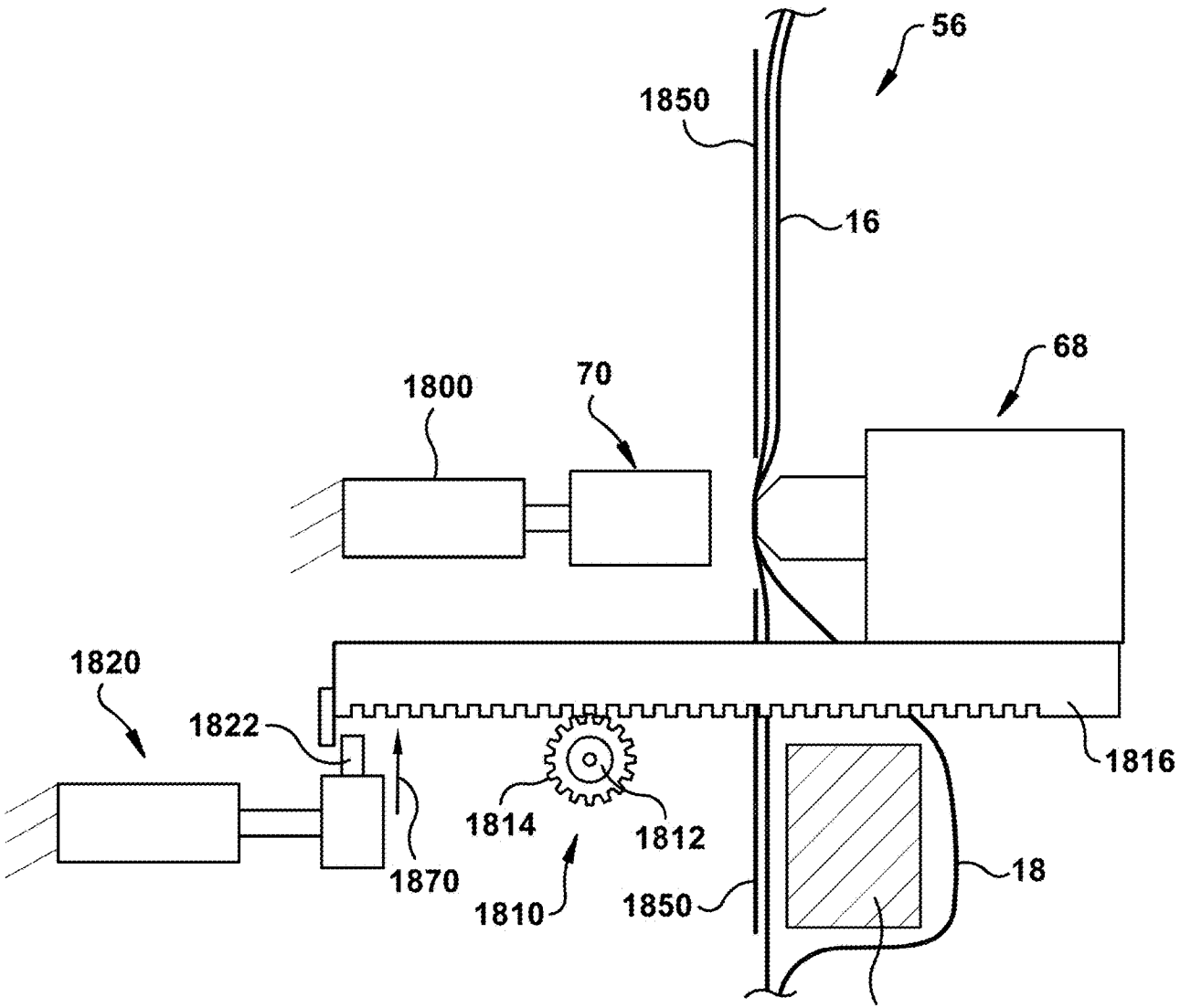
Figure 18D:
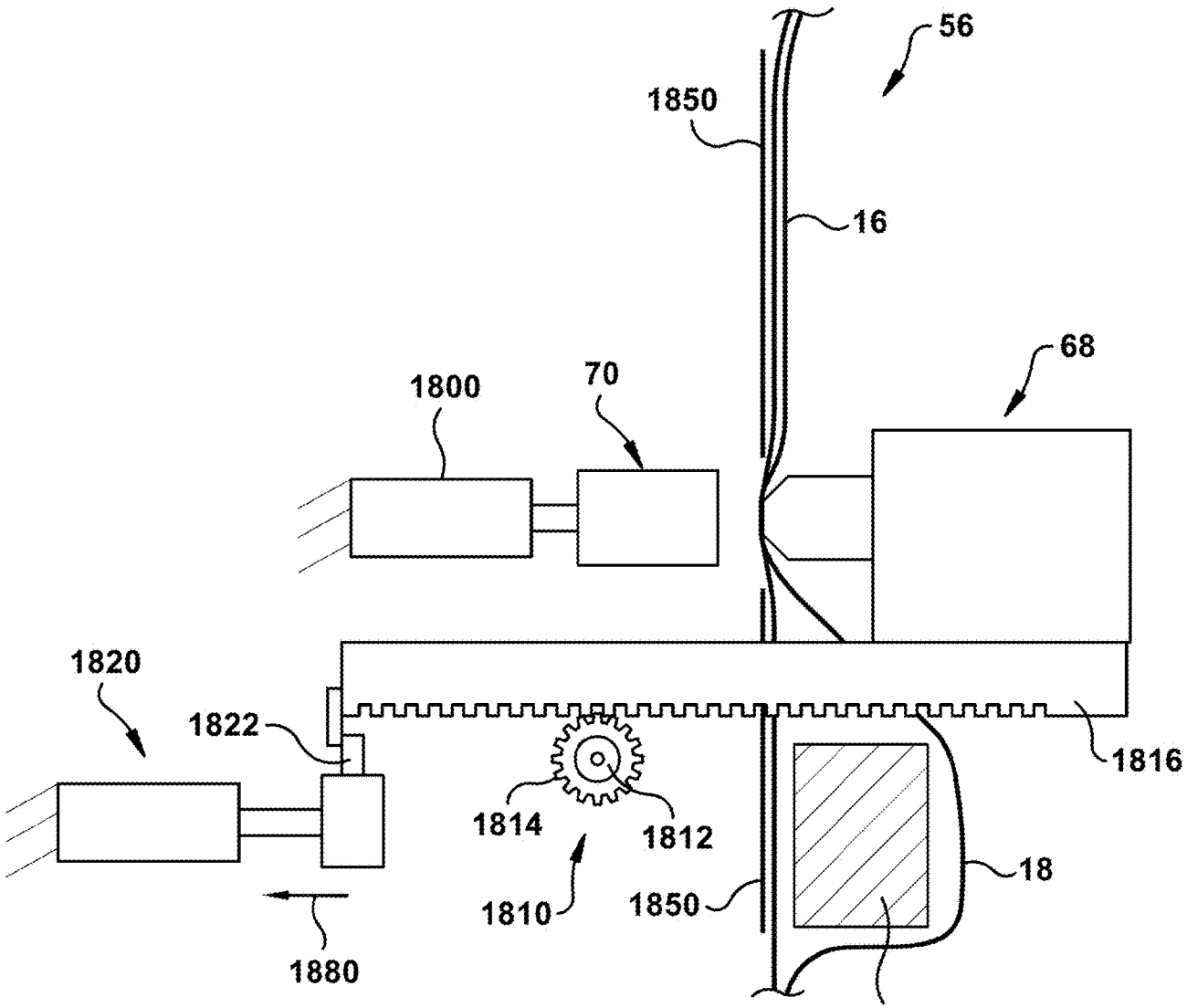

FIG. 18A illustrates the sealing assembly 56 in an open or load position, In the open or load position, the low force actuator 1810 positions the seal backing bar 68 in a spaced apart relationship to a front panel 1850 of the machine 10. In this position, the actuator 1800 positions the heating element 70 in a recessed relationship with respect to the front panel 1850. This prevents a user from inadvertently touching the heating element. Arrow 1860 in FIG. 18B illustrates the low force actuator 1810 moving the seal backing bar 68 to an engaged or sealing position. Arrow 1870 in FIG. 18C illustrates the latch member 1822 of the clamping actuator 1820 moving to a coupling position. Arrow 1880 in FIG. 18D illustrates the clamping actuator 1820 coupling to the low force actuator 1810, to hold the low force actuator 1810 in the clamping position.

Figure 18E:
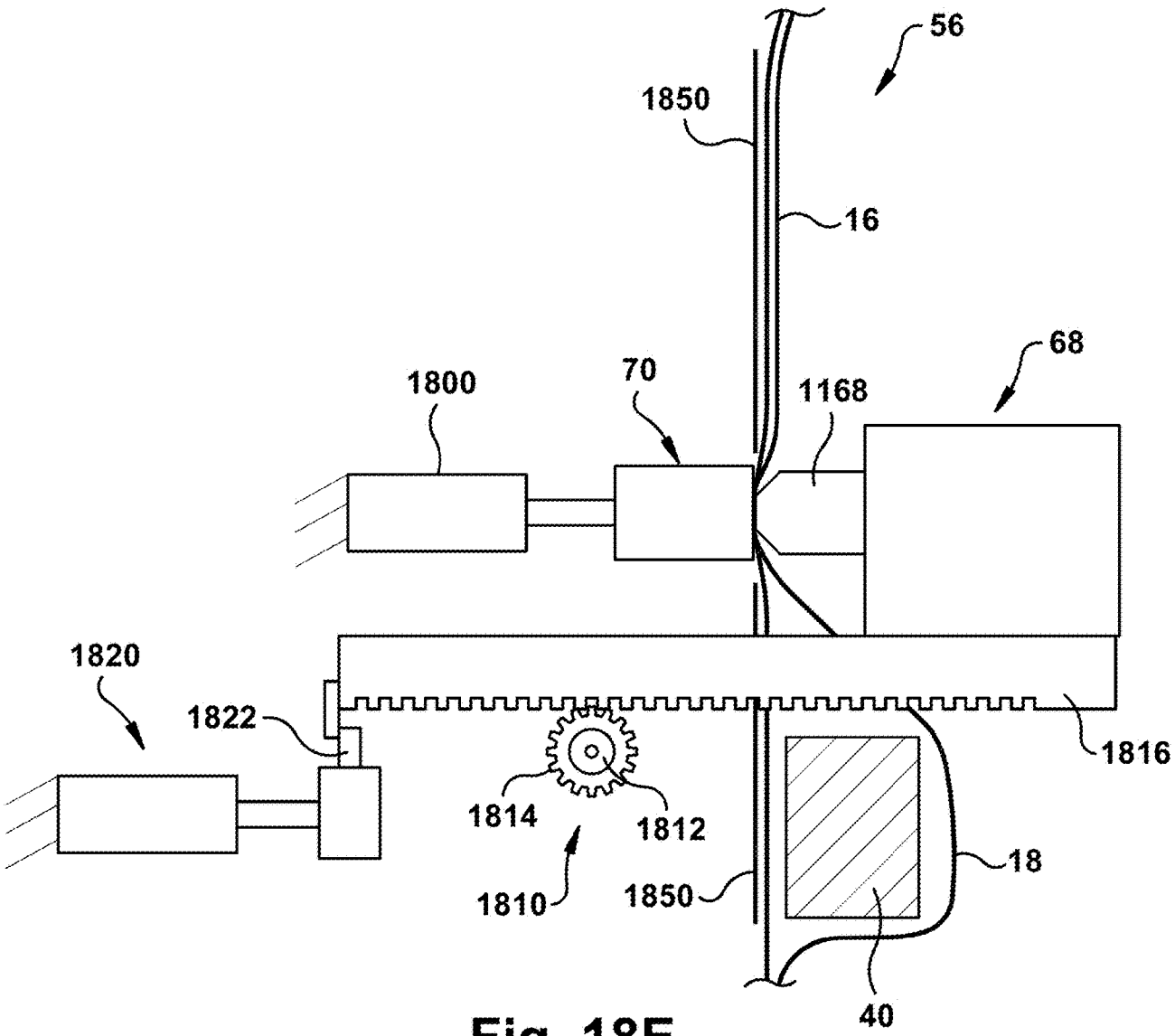

Arrow 1890 in FIG. 18E illustrates the heating element 70 moved by the actuator 1800 to a clamped or seal position. In an exemplary embodiment, the heating element 70 is moved to the clamped position and/or heat is applied by the heating element 70 only after the optional rubber seal backing element 1168 has been moved to the clamped position. The coupled clamping actuator 1820 and low force actuator 1810 prevent the actuator and heating element 70 from pushing the seal backing bar 68 away. That is, the coupled clamping actuator 1820 and low force actuator 1810 can oppose a much larger force applied by the actuator 1800 than the low force actuator 1810 alone. Since, the clamping actuator 1820 is not coupled to the low force actuator 1810 until the seal backing bar is in position, or substantially in position, there is no risk that a user's fingers can be pinched by the forces applied by the actuator 1800 and clamping actuator 1820. The only force that could be applied to a user's fingers is the force applied by the low force actuator 1810, which is lower than a force that could possibly injure a finger. In the illustrated embodiment, the seal backing bar 68 comprises the rubber seal backing element 1168, which is not heated. Heat is applied to the web to seal the plies of the web together. In one exemplary embodiment, the web 16 is reverse indexed while the bag 18 is clamped between the seal backing bar 68 and heating element 70 to separate the bag 18 from the rest of the web. The operations illustrated by FIGS. 18A-18E are performed in reverse order to release the bag.

Figure 12C:
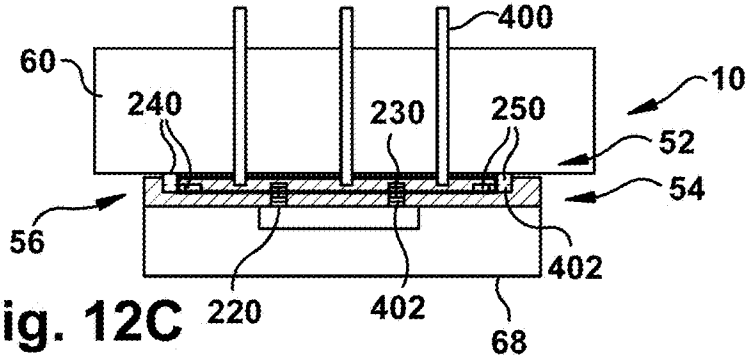
FIG. 12C is a top view of the apparatus and elongated web shown in FIG. 12A.
Figure 12A:
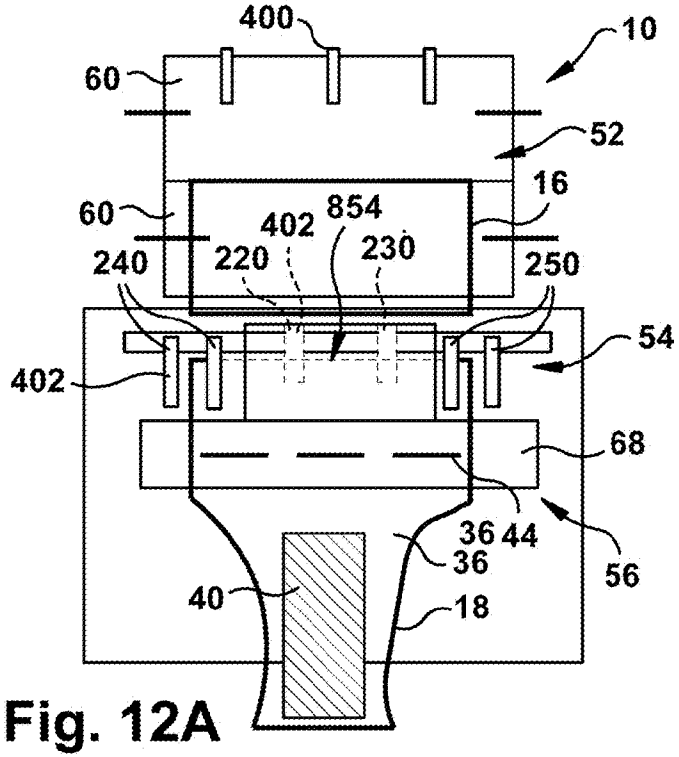
FIG. 12A is a front view of the apparatus showing reverse indexing of the web to separate the filled and sealed bag from the web.
Figure 12B:
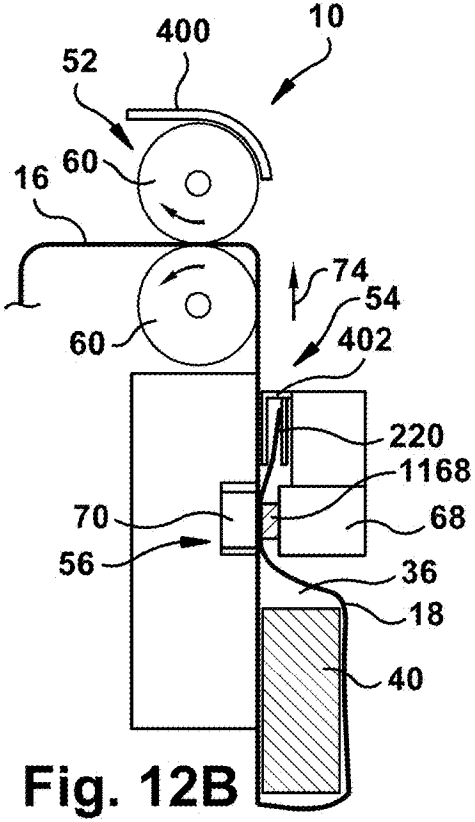
FIG. 12B is a side view of the apparatus and elongated web shown in FIG. 12A.

Referring to FIGS. 12A-12C, the engagement device 402 releases the bag. This release may be after the seal is formed or while the seal is being formed. This release may be before (see FIG. 12B) or after (see FIG. 13B) the seal backing bar 68 and a heating element 70 move apart from one another. In an exemplary embodiment, the controller causes the engagement device 402 to release the bag by causing the grippers 220, 230, 240, 250 to move from the closed position (FIGS. 11A-11C) to the open position (FIGS. 12A-12C).

Still referring to FIGS. 12A-12C, the controller controls the indexing mechanism 52 to separate the formed package 12 from the web 16. The second ply 22 is broken along the remaining middle portion 854 (the middle portion 854 is already broken off in the illustration of FIGS. 12A-12C) of the line of separation 32 to separate the package 12 from the elongated web 16. In the illustrated embodiment, the controller controls the indexing arrangement 52 to pull the web 16 away from the bag 18 as indicated by arrows 74 while the bag is clamped by the sealing arrangement 56 in an exemplary embodiment.

Figure 13C:
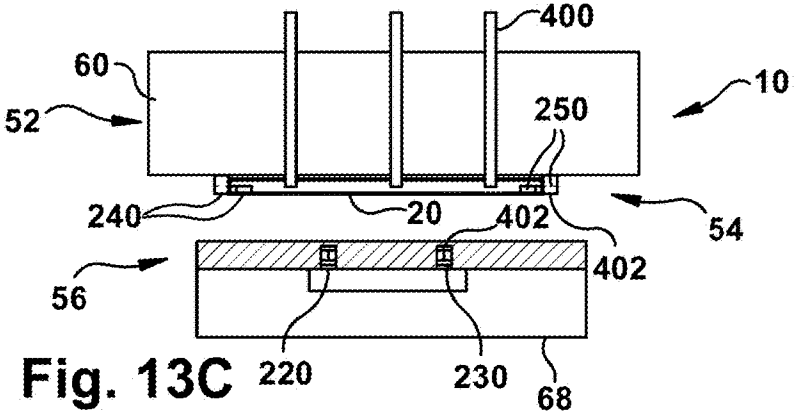
FIG. 13C is a top view of the apparatus and elongated web shown in FIG. 13A.
Figure 13A:
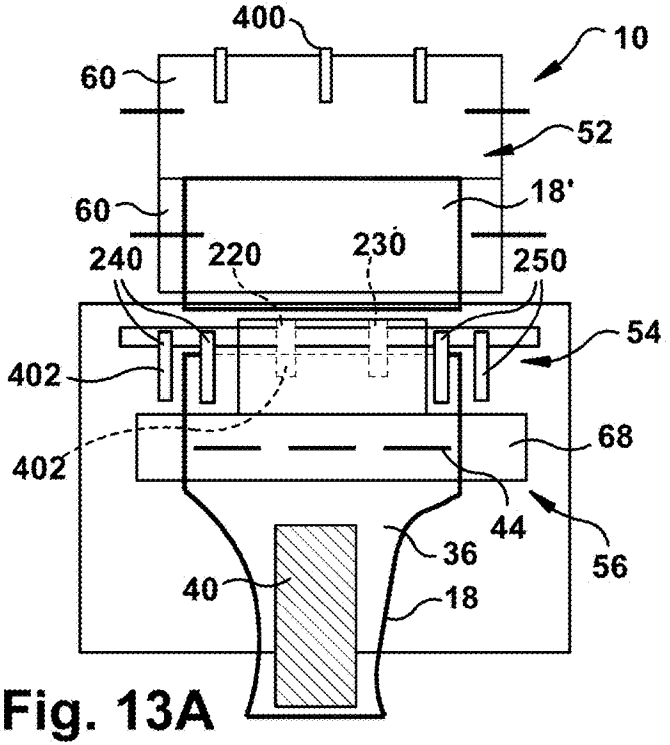
FIG. 13A is a front view of the apparatus showing releasing the filled and sealed bag from the apparatus.
Figure 13B:
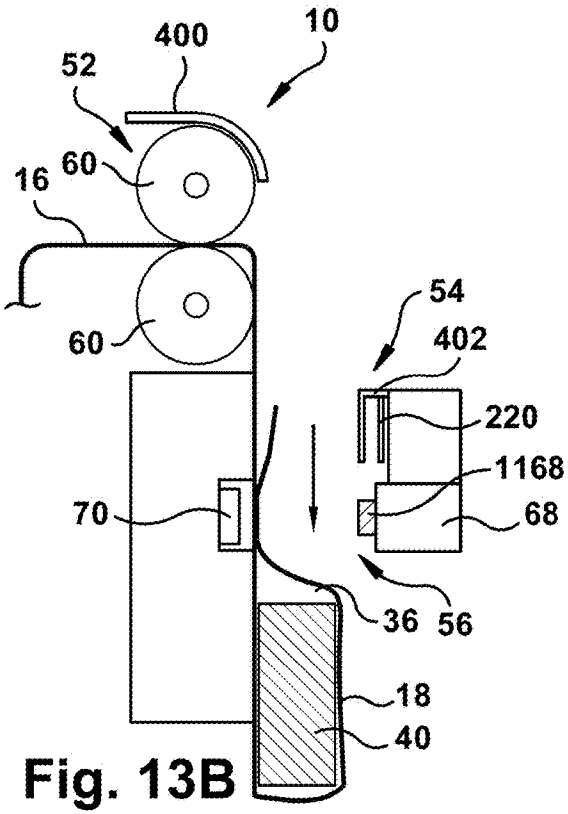
FIG. 13B is a side view of the apparatus and elongated web shown in FIG. 13A.

Referring to FIGS. 13A-13C, the controller controls the sealing arrangement 56 to release the formed package 12 after the filled bag 18 is separated from the next, unfilled bag 18'. In the illustrated embodiment, the formed package 12 is released by moving the seal backing bar 68 away from the heating element 70.

Referring again to FIGS. 3A-3C, the controller 58 indexes the web 16 with the opening 30 of the next bag 18 to the load position and the cycle begins again. The controller may repeat the method as required to produce as many packages are needed from the web.

Figure 19:
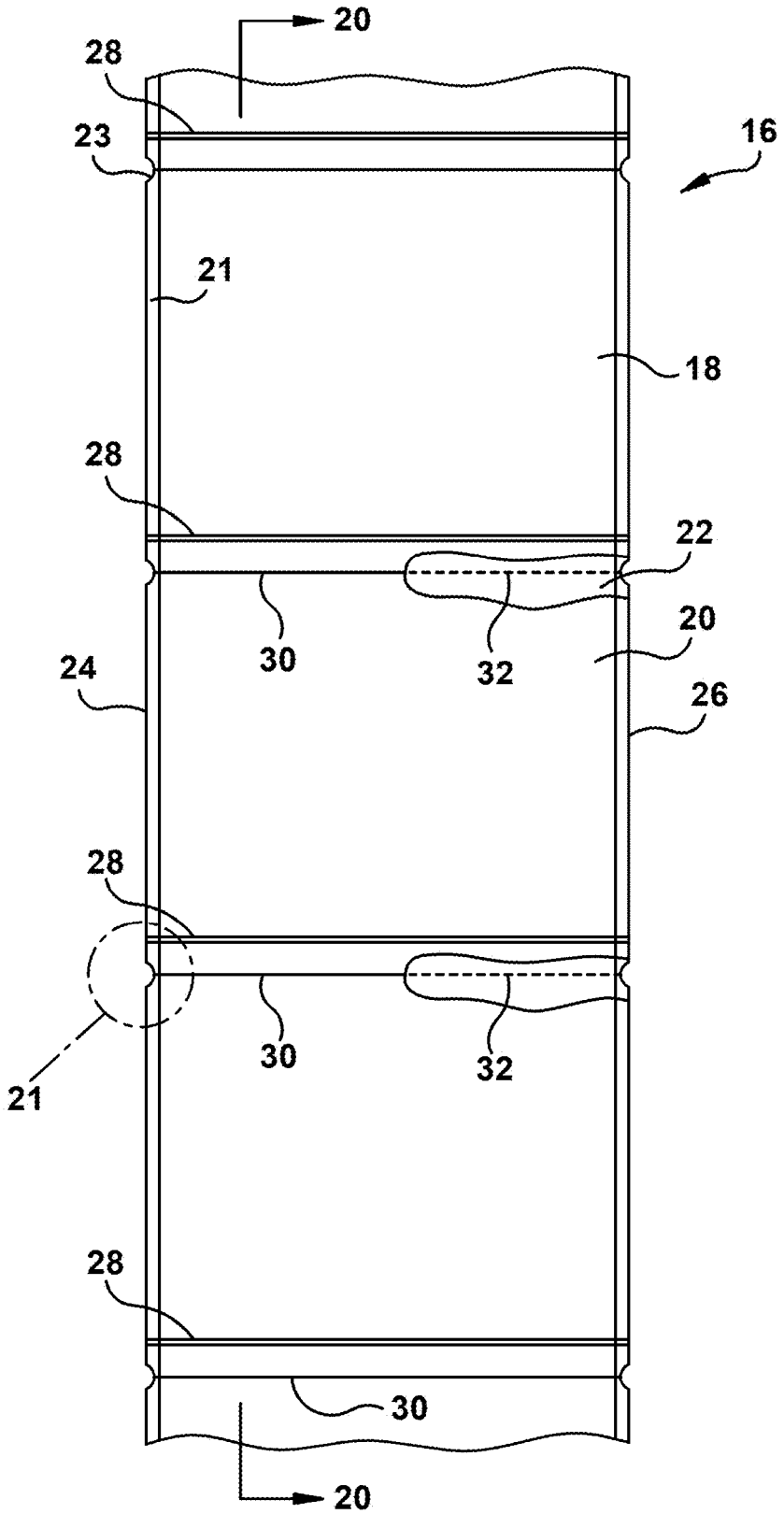
FIG. 19 is a view, partially cut away, of an exemplary embodiment of a new elongated web of bags.
Figure 20:
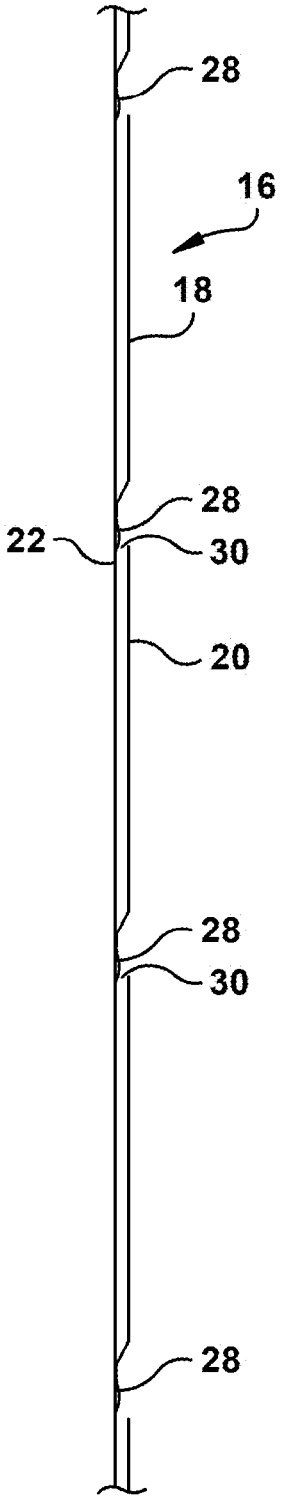
FIG. 20 is a sectional view taken along the plane indicated by lines 20-20 in FIG. 19.

Referring to FIGS. 19-20, exemplary embodiments of a web 16 are shown. Each preformed bag 18 is defined by first and second plies 20, 22 of the web 16. First and second side edges 24, 26 of the web hermetically join the first and second plies. Preformed seals 28 extend between the first and second side edges 24, 26. The opening 30 extends between the first and second side edges 24, 26. The line of separation 32, such as a line of perforations in the second ply 22 extends between the first and second side edges 24, 26. In one exemplary embodiment, the opening 30 is superposed over the line of perforations 32. In another exemplary embodiment, the opening 30 and the line of perforations 32 are offset. In one exemplary embodiment, the opening 30 is replaced with a line of perforations. When the opening 30 is replaced with a line of perforations, the perforations that replace the opening 30 may optionally be weaker than the perforations 32.

The web 16 of FIG. 19 includes side seals 21 parallel to and proximate the first and second side edges 24, 26. The side seals 21 have a width of about 0.030 inches to about 0.500 inches, such as, for example, 0.100 inches to 0.250 inches. However, the seals 21 may have any range of widths that are within the range of 0.030 inches to 1 inch (i.e. 0.223 to 0.250, 0.8 to 1.0, 0.24 to 0.26, etc., i.e. any sub-range). The relatively thick seals 21 increase the force required to tear a loaded and sealed bag from the remainder of the bags. Cuts 23 in the side seals 21 are aligned with the opening 30 and/or the line of perforations 32. The cuts 23 reduce or eliminate the force necessary to break the side seals 21 when the bags 18 are torn along the line of perforations 32. The reduced breaking force of the side seals 21 allows the bags 18 to be opened more easily, and prevents the first and second side edges 24, 26 of the bag 18 from being pulled inward when the bags 18 are opened. The bags 18 may be opened with any of the packaging machines described above, or by the machines described in U.S. Pat. No. 8,307,617 to Riccardi et al. and U.S. Pat. No. 8,887,978 to Chuba, which are incorporated herein by reference in their entirety. The bags 18 may also be opened by hand.

Figure 21A:
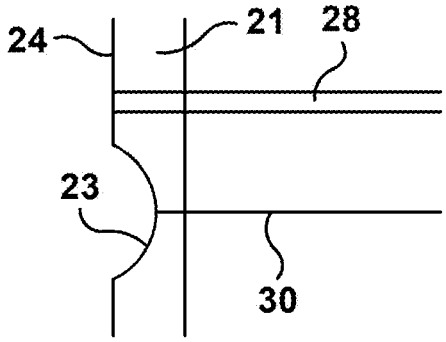
FIGS. 21A-21C are enlarged views of the area of FIG. 19 indicated by the circle 21 in FIG. 19 showing various embodiments of the elongated web of bags with round cuts 23.
Figure 21B:
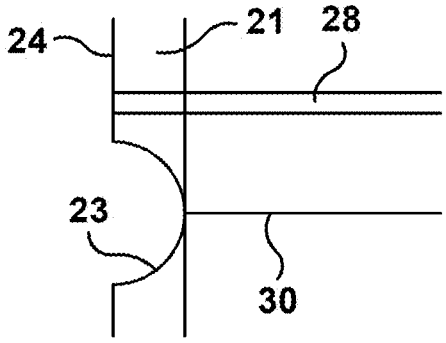
Figure 21C:
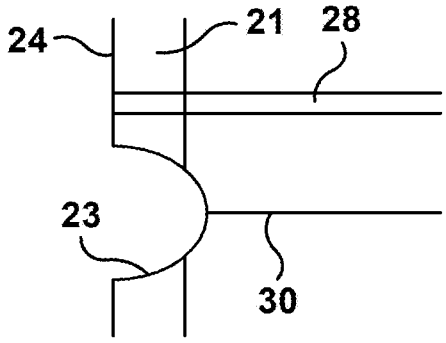
Figure 22A:
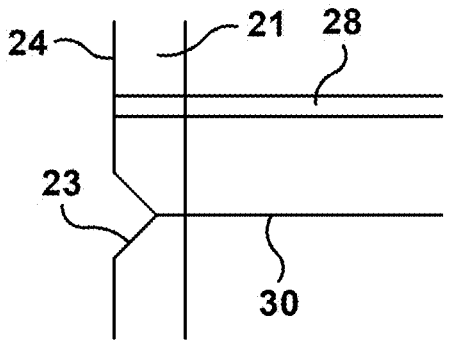
FIGS. 22A-22C are enlarged views of the area of FIG. 19 indicated by the circle 21 in FIG. 19 showing various embodiments of the elongated web of bags with V-shaped cuts 23.
Figure 22B:
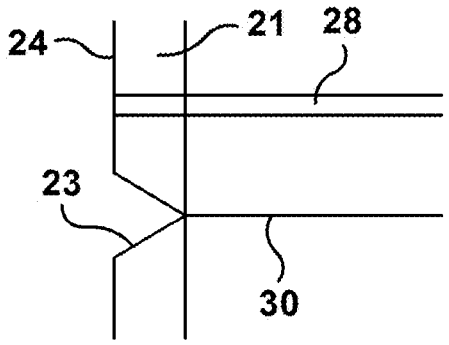
Figure 22C:
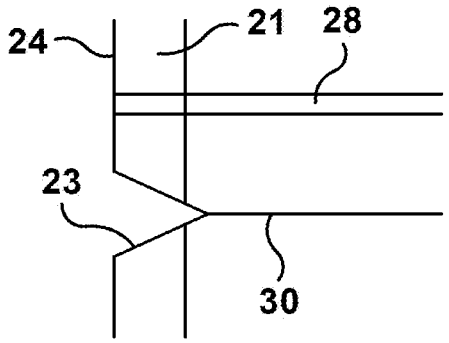
Figure 23A:
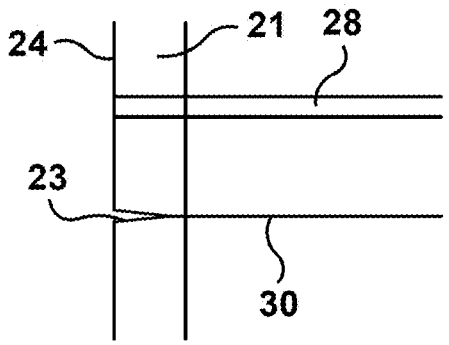
FIGS. 23A-23C are enlarged views of the area of FIG. 19 indicated by the circle 21 in FIG. 19 showing various embodiments of the elongated web of bags with slit cuts 23.
Figure 23B:
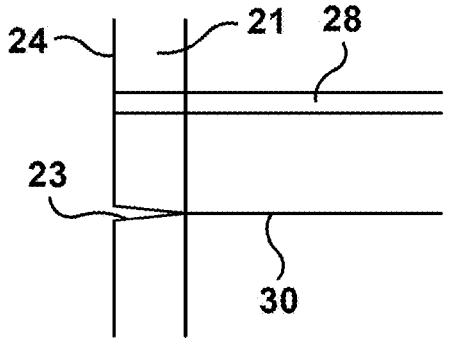
Figure 23C:
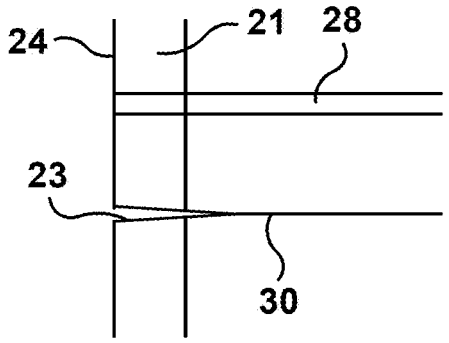

The cuts 23 can take on any suitable shape and have any size. For example, the exemplary embodiments of FIGS. 21A-21C have round cuts 23. The cuts 23 can also be V-shaped, as shown in FIGS. 22A-22C, or a slit, as shown in FIGS. 23A-23C. The cuts 23 may have the same width as the side seals 21, as shown in FIGS. 21B, 22B, and 23B. This eliminates any additional force that is needed to tear the bags apart along the line of perforations 32. The cuts may be narrower than the width of the side seals 21, as shown in FIGS. 21A, 22A, and 23A. For example, the cuts 23 may have a width that is 0.062 inches less than the width of the side seals 21 (or any sub-range between the width of the seals 21 and 0.062 inches less than the width of the seals 21). For example, the cuts may have a width that is 0.031 inches less than the width of the seals 21. The cuts 23 may be wider than the widths of the seals 21, as shown in FIGS. 21C, 22C, and 23C. For example, the cuts 23 may have a width that is up to 0.5 inches wider than the width of the side seals 21 (or any sub-range between the width of the seals 21 to 0.5 inches wider than the width of the seals 21).

FIGS. 24A-24C through 31A-31C schematically illustrate an exemplary embodiment of a machine being operated to make packages 12 from an elongated web 16 of preformed interconnected bags 18 (See FIGS. 14 and 15). Any apparatus represented by the schematic illustrations of 24A-24C through 31A-31C can be used that performs the functions shown by FIGS. 24A-24C through 31A-31C. The concepts of the apparatus 2400 can be implemented in any of a wide variety of packaging machines. For example, U.S. Pat. No. 3,254,468 to H. Lerner, U.S. Pat. No. 4,928,455 to Gereby et al., U.S. Pat. No. 5,341,625 to Kramer, U.S. Pat. No. 5,394,676 to B. Lerner et al., U.S. Pat. No. 6,543,201 to Cronauer et al., U.S. Pat. Nos. 6,742,317, 5,394,676, 5,371,521, and 4,899,520 disclose packaging machines that can be modified in accordance with the present invention to make packages from an elongated web of preformed interconnected bags and are all incorporated herein by reference in their entirety.

Figure 24C:
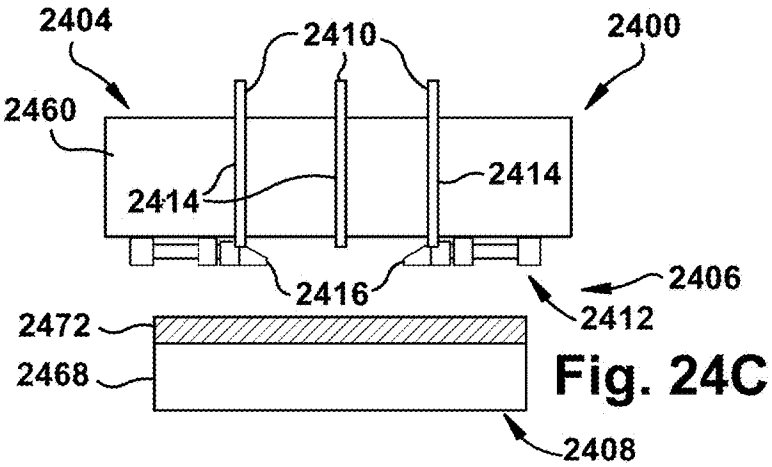
FIG. 24C is a top view of the apparatus shown in FIG. 24A.
Figure 24A:
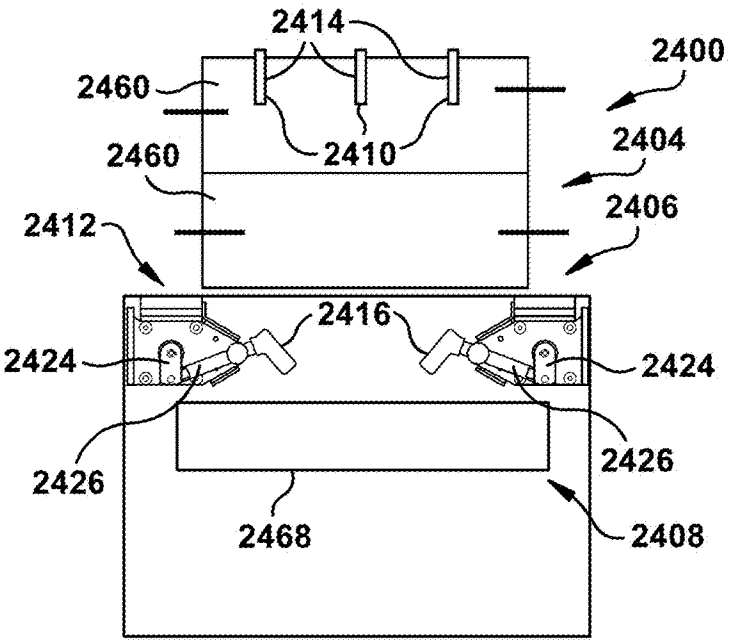
FIG. 24A is a front view of another exemplary apparatus for making packages from an elongated web of preformed interconnected bags.
Figure 24B:
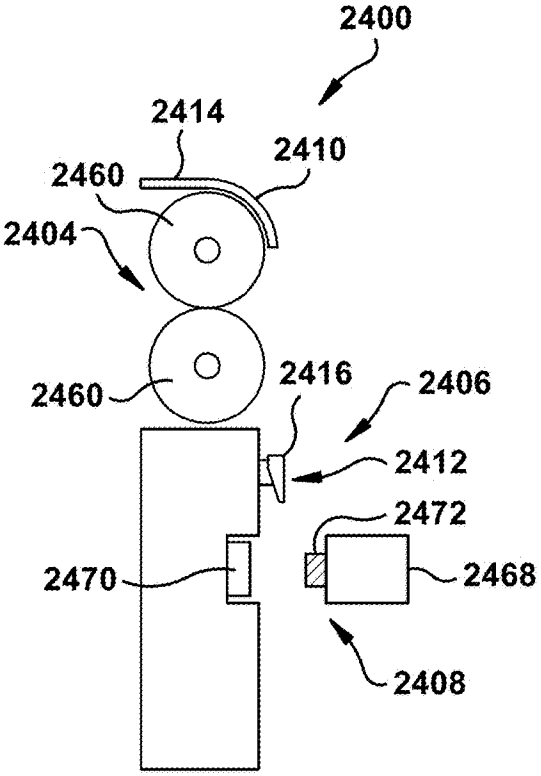
FIG. 24B is a side view of the apparatus shown in FIG. 24A.
Figure 25C:
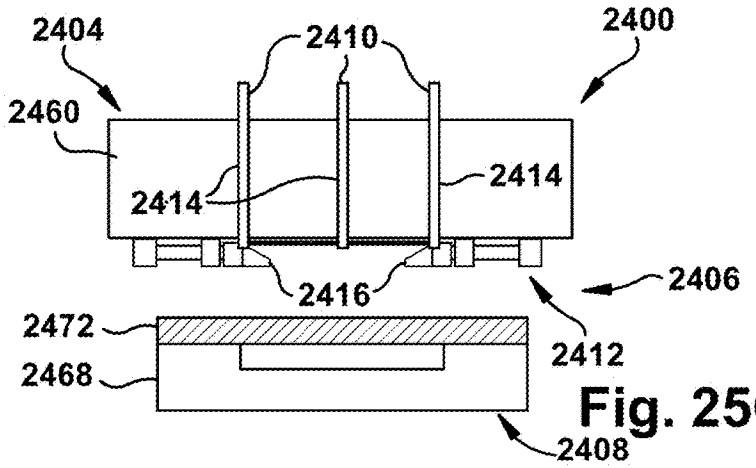
FIG. 25C is a top view of the apparatus and elongated web shown in FIG. 25A.
Figure 25A:
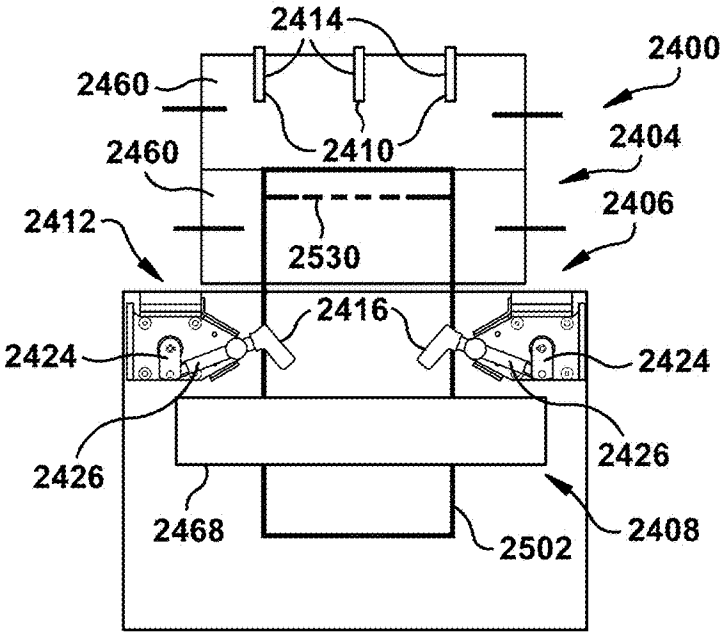
FIG. 25A is a front view of the apparatus showing the elongated web being advanced through the apparatus.
Figure 25B:
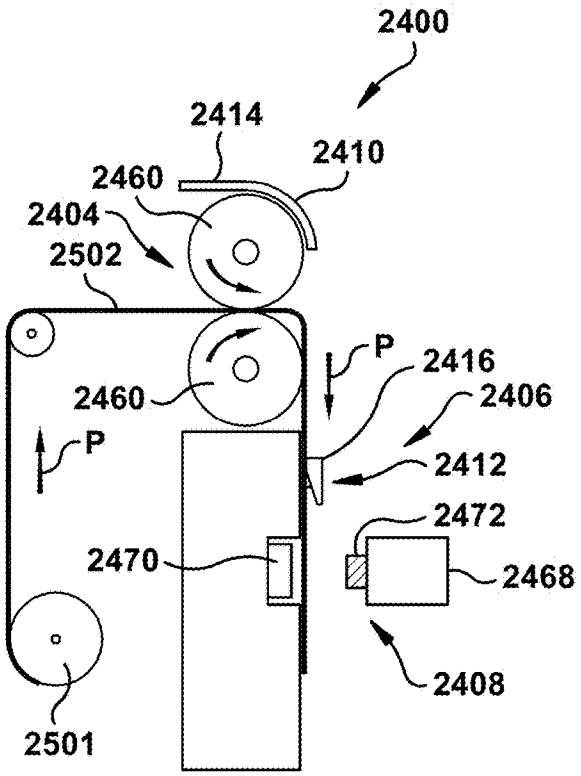
FIG. 25B is a side view of the apparatus and elongated web shown in FIG. 25A.
Figure 26C:
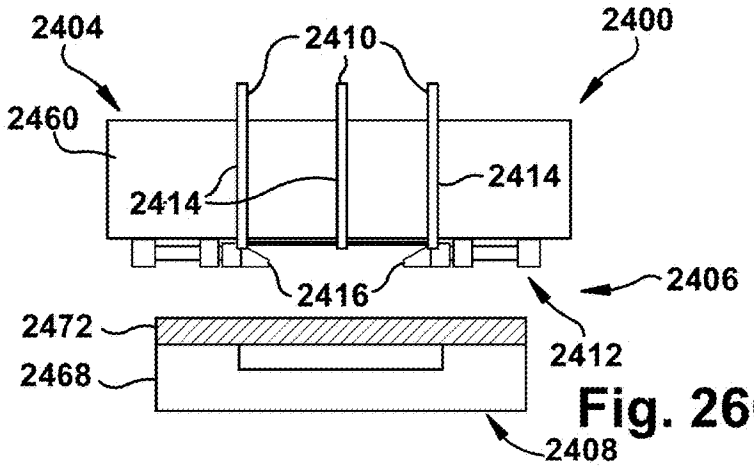
FIG. 26C is a top view of the apparatus and elongated web shown in FIG. 26A.
Figure 26A:
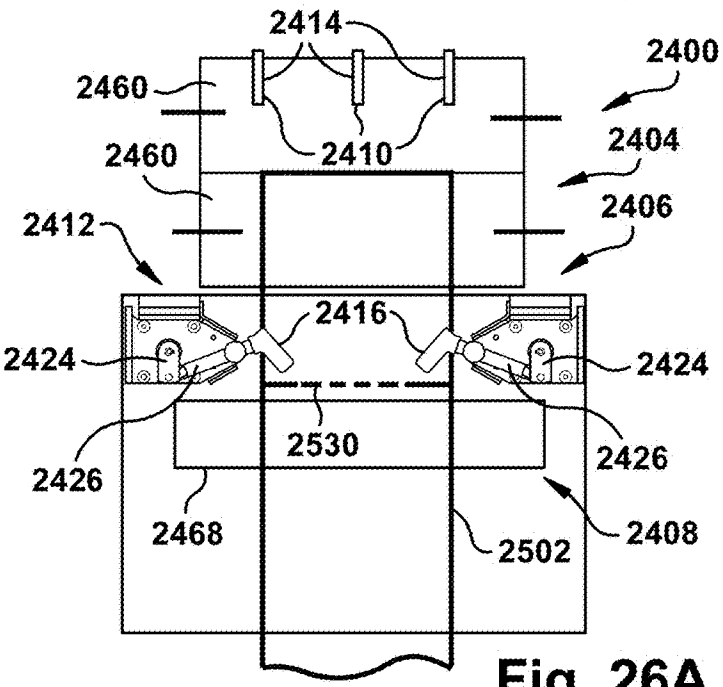
FIG. 26A is a front view of the apparatus showing the elongated web opening being positioned below a bag opening arrangement of the apparatus.
Figure 26B:
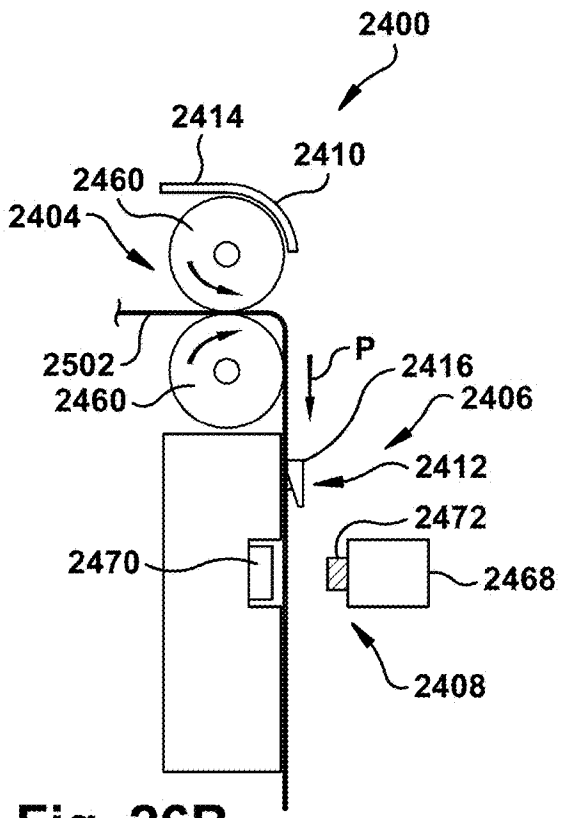
FIG. 26B is a side view of the apparatus and elongated web shown in FIG. 26A.
Figure 27C:
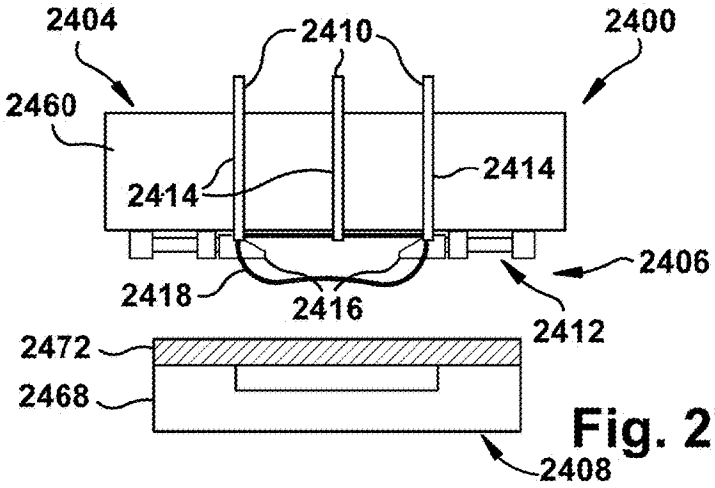
FIG. 27C is a top view of the apparatus and elongated web shown in FIG. 27A.
Figure 27A:
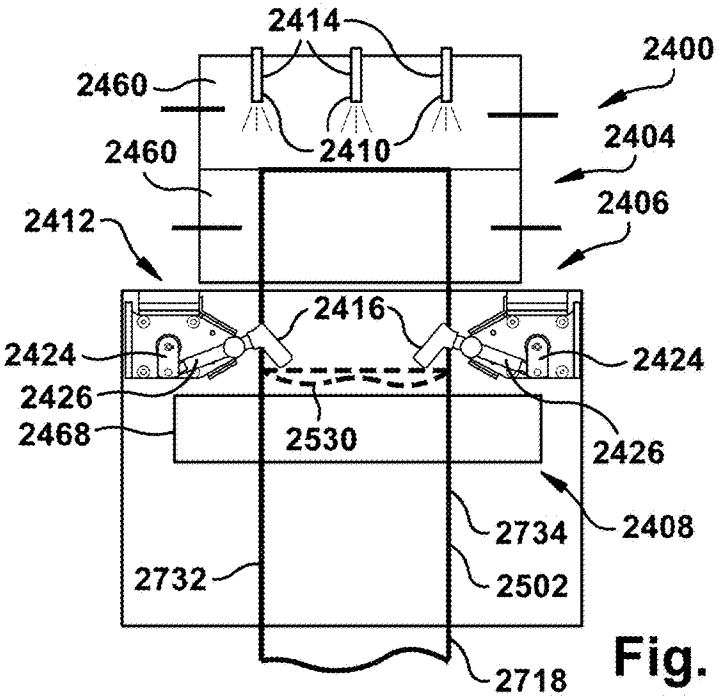
FIG. 27A is a front view of the apparatus showing the web opening being blown open to form a bag opening.
Figure 27B:
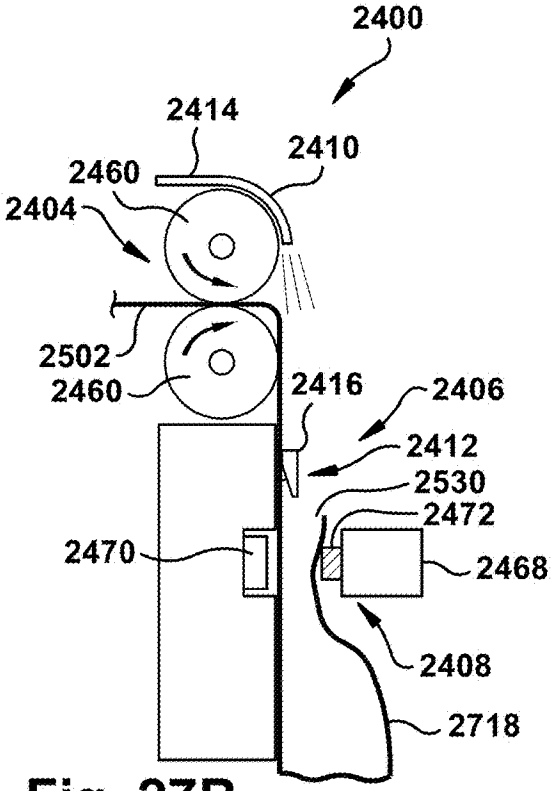
FIG. 27B is a side view of the apparatus and elongated web shown in FIG. 27A.
Figure 28C:
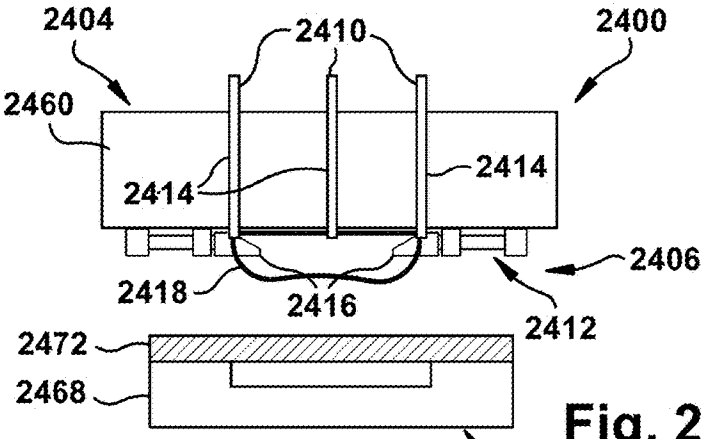
FIG. 28C is a top view of the apparatus and elongated web shown in FIG. 28A.
Figure 28A:
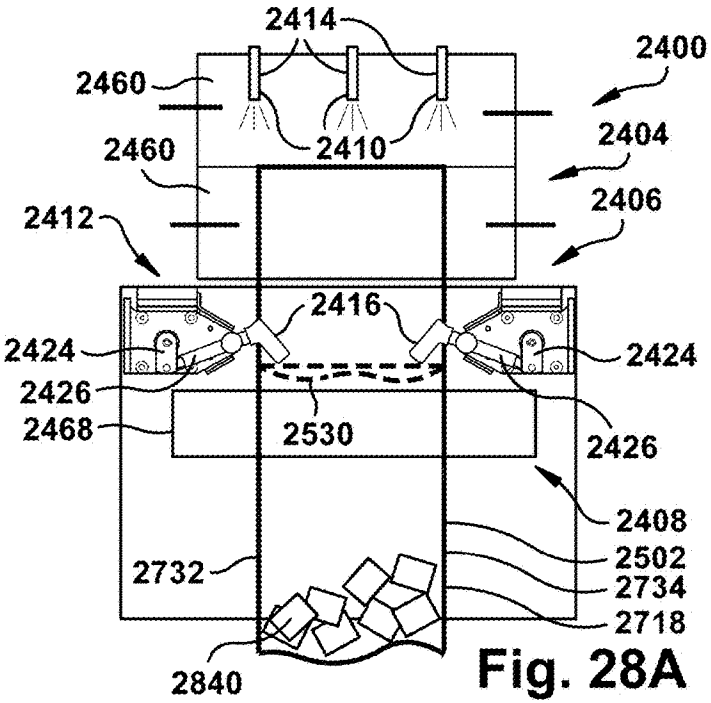
FIG. 28A is a front view of the apparatus showing products positioned in the open bag.
Figure 28B:
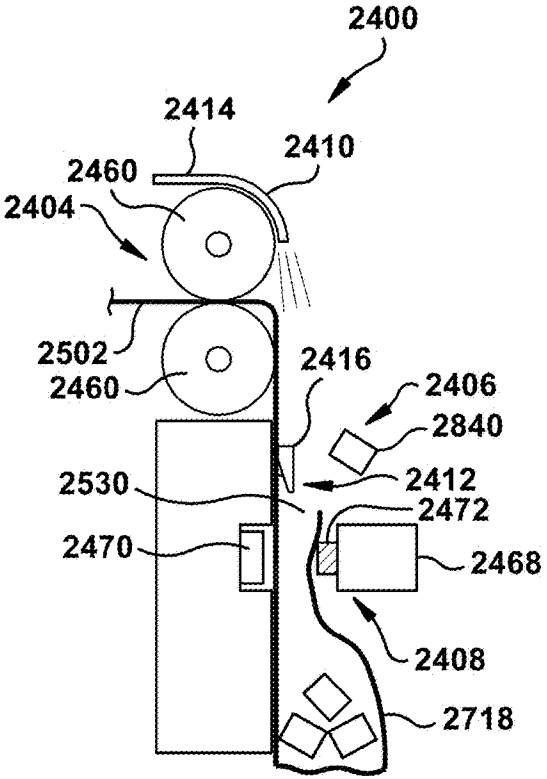
FIG. 28B is a side view of the apparatus and elongated web shown in FIG. 28A.

Referring to FIGS. 24A-24C, the illustrated apparatus 2400 includes a supply 2501 (FIG. 25B) of the elongated web 2502 (FIG. 25B) of preformed interconnected bags 2718 (FIG. 27A), an indexing mechanism 2404, an opening arrangement 2406, an engagement device 2412, a sealing arrangement 2408, and a controller (not shown). The supply 2501 of the elongated web 2502 is rolled or folded to stage a relatively large amount of the web 2502 in a relatively small space. The web 2502 is routed from the supply 2501 along a path of travel P to the indexing mechanism 2404. The indexing mechanism 2404 receives the web 2502 from the supply 2501 and moves the web 2502 along the path of travel P. The indexing mechanism 2404 may take a wide variety of different forms. For example, any indexing mechanism 2404 that can be controlled to index bags 2718 of the web 2502 to selected positions along the path of travel P may be used. In the illustrated example, the indexing mechanism 2404 includes a pair of rollers 2460 that form a nip that engages the web 2502. The rollers 2460 are selectively driven by a motor (not shown) to index bags 2718 of the web 2502 to selected positions along the path of travel P.

Still referring to FIGS. 24A-24C, the opening arrangement 2406 is positioned along the path of travel P to open each bag 2718 that is to be loaded and sealed. The opening arrangement may take a wide variety of different forms. For example, in the illustrated embodiment, the opening arrangement 2406 comprises a blower 2410. The blower 2410 may also take a wide variety of different forms. For example, in the illustrated embodiment, the blower 2410 comprises a plurality of nozzles 2414 positioned above the rollers 2460 of the indexing mechanism 2404. The nozzles 2414 are oriented downward to blow air downward past the rollers 2460 along the path of travel P of the web 2502.

Referring to FIGS. 24A-24C, the engagement device 2412 is configured to close and flatten the bags for sealing. The engagement device 2412 can take a wide variety of different forms. In the illustrated embodiment, a pair of engagement devices 2412 are positioned to engage opposite sides 2732, 2734 (FIG. 27A) of a bag 2718. Each illustrated engagement device 2412 includes a finger 2416, a first link 2424, a second link 2426 pivotably connected to the first link 2424, and a sliding pivot 3202 that the second link 2426 extends through. The fingers 2416 are spaced apart so that one finger 2416 engages a side 2732 of the bag 2718 and the other finger 2416 engages an opposite side 2734 of the bag 2718. In one exemplary embodiment, the fingers 2416 are driven by a motor (not shown). The motor causes the first link 2424 to move between a first position (FIGS. 24A-28A) and a second position (FIGS. 29A-31A). The motor may be, for example, a stepper motor, a motor including pneumatic rotary cylinders, or any other suitable motor for moving the first link between the first and second positions. In one embodiment, the angle between the first link 2424 in the first position and the first link 2424 in the second position is between about 90 degrees and 270 degrees. In another embodiment, the angle between the first link 2424 in the first position and the first link 2424 in the second position is between about 120 degrees and 240 degrees. In another embodiment, the angle between the first link 2424 in the first position and the first link 2424 in the second position is between about 150 degrees and 210 degrees. In another embodiment, the angle between the first link 2424 in the first position and the first link 2424 in the second position is about 180 degrees.

The second link 2426 is driven by the first link 2424, and is moveable between a first position (FIGS. 24A-28A) and a second position (FIGS. 29A-31A). In the illustrated exemplary embodiment, the finger 2416 is attached to the second link 2426. As the second link 2426 is moved between the first position and second position by the first link 2424, the finger 2416 moves downward into the bag opening 2530 and retracts to pull the sides 2732, 2734 of the bag opening 2530 in opposite directions so that the bag opening 2530 flattens and closes. The movement of the engagement device 2406 is more clearly provided in FIGS. 32A-32G. In certain embodiments, the length of the second link 2426 is adjustable and/or resiliently extendable (i.e., spring loaded) so that the second link 2426 can extend or retract depending on the width of the opening 2530 of the bag 2718 and/or to accommodate any misalignment of the bag 2718. The length of the second link 2426 may be automatically adjusted by the controller, the second link 2426 may be manually adjusted, and/or the second link may be resiliently extendable.

Referring to FIGS. 24A-24C, the controller is in communication with the indexing mechanism 2404, the opening arrangement 2406, the engagement device 2412, and the sealing arrangement 2408. The controller controls the indexing mechanism 2404, the opening arrangement 2406, the engagement device 2412, and the sealing arrangement 2408 to convert the preformed bags 2718 into packages. A wide variety of controllers can be used and programmed to the indexing mechanism 2404, the opening arrangement 2406, and the sealing arrangement 2408 as described herein. For example, the controller and controller algorithms described in U.S. Pat. No. 5,341,625 to Kramer can be modified to control the indexing mechanism 2404, the opening arrangement 2406, the engagement device 2412, and the sealing arrangement 2408 to form the packages.

Referring now to FIGS. 25A-25C and 26A-26C, the controller controls the indexing mechanism 2404 to move the web 2502 forward along the path of travel as indicated by arrows P, until the opening 2530 of the bag 2718 is below the blower 2410 in the exemplary embodiment. The opening 2530 can be indexed to any position where the blower 2410 can blow the opening 2530 open or at least partially open. In the illustrated embodiment, the opening 2530 of the bag 2718 is below the fingers 2416.

Referring to FIGS. 27A-27C and FIGS. 28A-28C, the controller controls the blower 2410 to blow air out of the nozzles 2414 toward the opening 2530 of the bag 2718. The air is blown through the opening 2530 to inflate the bag 2718. While the bag 2718 is at a load position, the bag 2718 is maintained in an inflated condition to keep the opening 2530 open and products 2840 are loaded into the bag 2718. The products 2840 may be loaded manually or automatically. In the illustrated embodiment, the position where the bag 2718 is loaded is also the position where bag 2718 is sealed after the opening 2530 is closed. In another embodiment, the position where the bag 2718 is loaded is different than the position where the bag 2718 is sealed. In this embodiment, the controller causes the indexing mechanism 2404 to move the bag 2718 to the seal position after the bag 2718 is loaded with product 2840 and closed.

In certain embodiment, after the product 2840 is loaded in the bag 2718, an operator may provide a signal to the controller to indicate that loading is complete, or completion of loading may be automatically detected. The apparatus 2400 may be configured to allow the operator to provide the completed loading signal to the controller in a wide variety of different ways. For example, the apparatus 2400 may have a control foot pedal (not shown) or the sealing arrangement 2408 may have a portion that the operator can push on to indicate that loading is complete and it is time to seal the package. Similarly, the apparatus 2400 can be configured to automatically detect completed loading and provide the controller with a signal indicating this fact. For example, the apparatus 2400 may include a counter or may weigh the package to detect completed loading.

Referring to FIGS. 28A-28C and FIGS. 29A-29C, the signal from the operator or detection of completed loading is communicated to the controller, and the controller causes the engagement device 2412 to close the bag 2718. In the illustrated embodiment, the fingers 2416 move into the opening 2530 of bag 2718 and pull the sides 2732, 2734 of the bag 2718 in opposite directions (shown by reference number 2901 on FIG. 29C) to close the bag 2718 and flatten the area where the bag 2718 will be sealed. Once the fingers 2416 close the opening 2530, the bag 2718 may be sealed at the position illustrated by FIGS. 29A-29C. In various embodiments, the bag 2718 is sealed while the engagement device 2412 is holding the bag 2718 closed. The sealing arrangement 2408 is positioned along the path of travel P to provide the seal 2944. The sealing arrangement 2408 may take a wide variety of different forms. For example, any mechanism that applies heat to the web 2502 to seal the opening 2530 of the bag 2718 may be implemented.

Figure 29C:
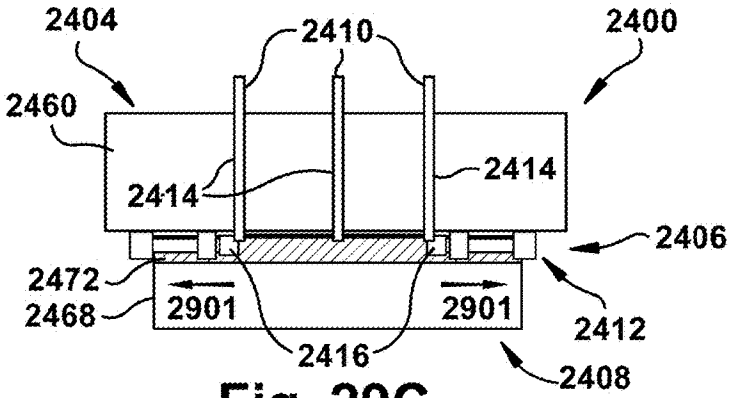
FIG. 29C is a top view of the apparatus and elongated web shown in FIG. 29A.
Figure 29A:
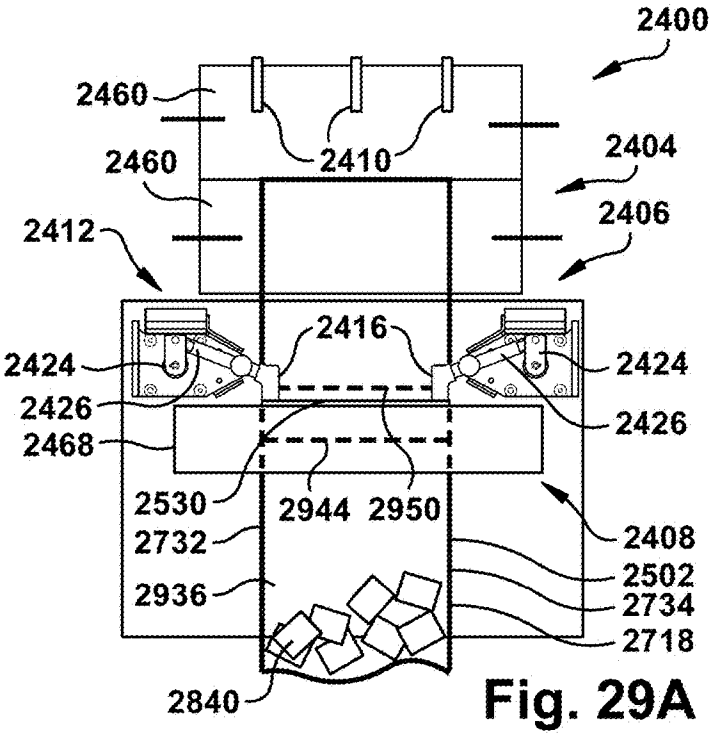
FIG. 29A is a front view of the apparatus showing the bag engagement devices moving to close the bag and the bag being sealed by a sealing arrangement of the apparatus.
Figure 29B:
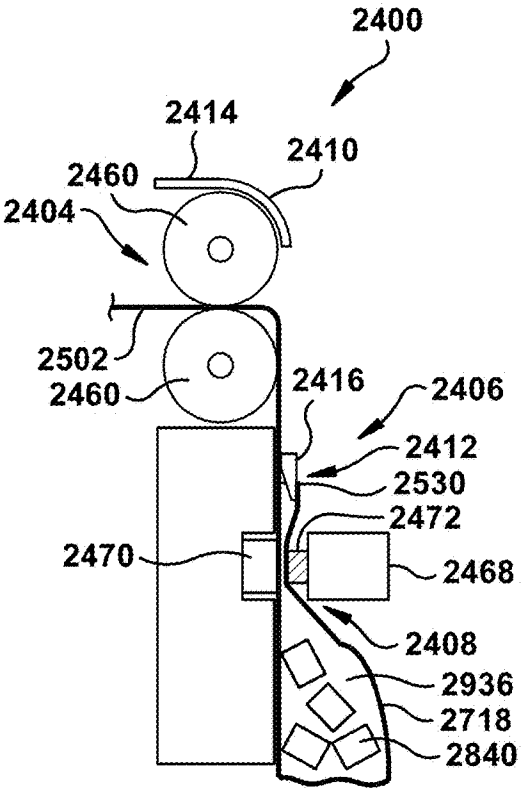
FIG. 29B is a side view of the apparatus and elongated web shown in FIG. 29A.

In the illustrated embodiment, the sealing arrangement comprises a seal backing bar 2468 and a heating element 2470 that are selectively moved into and out of engagement. Referring to FIG. 29B, when the web 2502 is in the seal position, the controller controls the sealing arrangement 2408 to clamp the web 2502 between the seal backing bar 2468 and the heating element 2470. In certain embodiments, the seal backing bar 2468 comprises a rubber seal backing element 2472. The seal backing bar 2468 may be moved to the clamped position (See FIG. 29B) from the unclamped position (See FIG. 28B) under a low force, such as a force that is lower than a force that could injure a finger that might be between the rubber seal backing element 2472 and the heating element 2470. In addition, the rubber seal backing element 2472 is not heated.

In various embodiments, the heating element 2470 is moved to the clamped position (See FIG. 29B) from the unclamped position (See FIG. 28B) and/or heat is applied by the heating element 2470 only after the rubber seal backing element 2472 has been moved to the clamped position. Heat is applied to the web 2502 to seal the opening 2530 of the bag 2718. The heating element 2470 may be continuously on (i.e. always hot when the machine is turned on) or the heating element 2470 may be controlled to only apply heat when the bag 2718 is clamped and/or a seal signal is provided by the controller. The opening 2530 of bag 2718 is sealed to form a compartment 2936 in the bag 2718.

The sealing arrangement 2408 shown in FIGS. 24A-24C through FIGS. 31A-31C may take several forms, including the form provided in FIGS. 18A-18E, which shows sealing arrangement 56 provided in FIGS. 1A-1C through FIGS. 13A-13C.

Figure 30C:
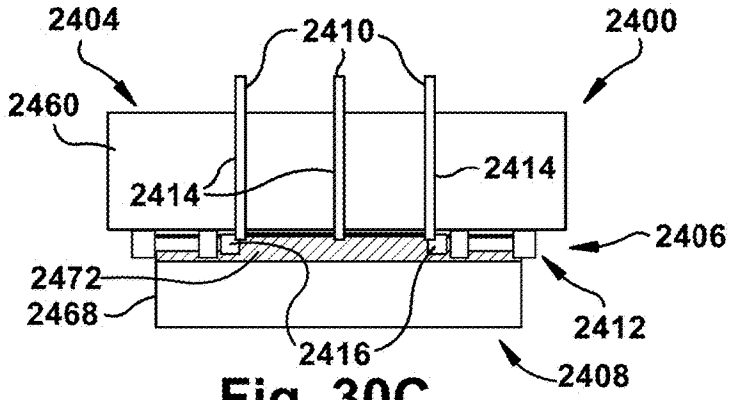
FIG. 30C is a top view of the apparatus and elongated web shown in FIG. 30A.
Figure 30A:
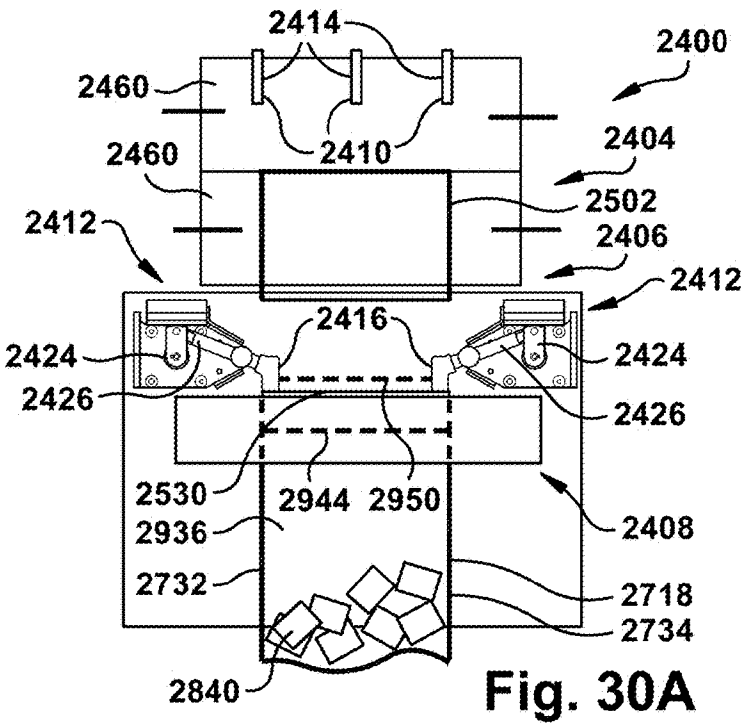
FIG. 30A is a front view of the apparatus showing reverse indexing of the web to separate the filled and sealed bag from the web.
Figure 30B:
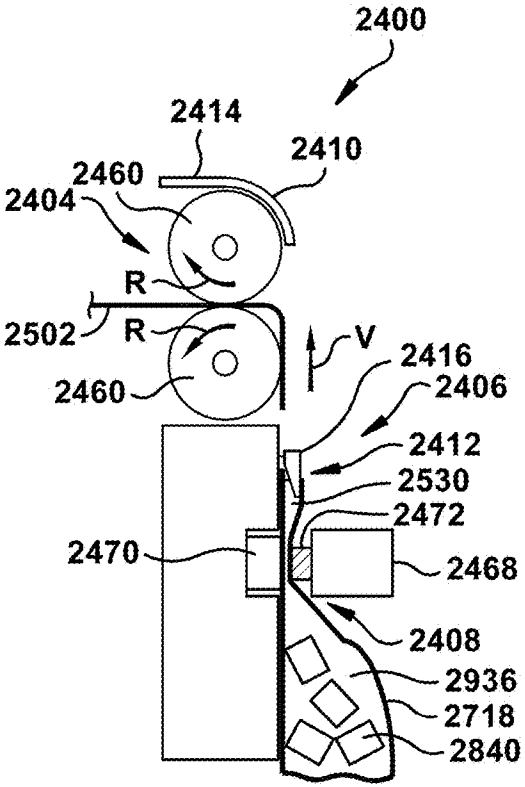
FIG. 30B is a side view of the apparatus and elongated web shown in FIG. 30A.

Referring to FIGS. 30A-30C, the controller controls the indexing mechanism 2404 to separate the bag 2718 holding products 2840 from the web 2502. In an exemplary embodiment, the sealing arrangement 2408 keeps the bag 2718 in the position shown in FIG. 29B when the bag is clamped by the sealing arrangement 2408. The indexing mechanism 2404 reverses direction (referenced by R), which moves the web 2502 in direction V. As the web moves in direction V, the bag 2718 is separated from the web 2502 along a separation line 2950.

Figure 31C:
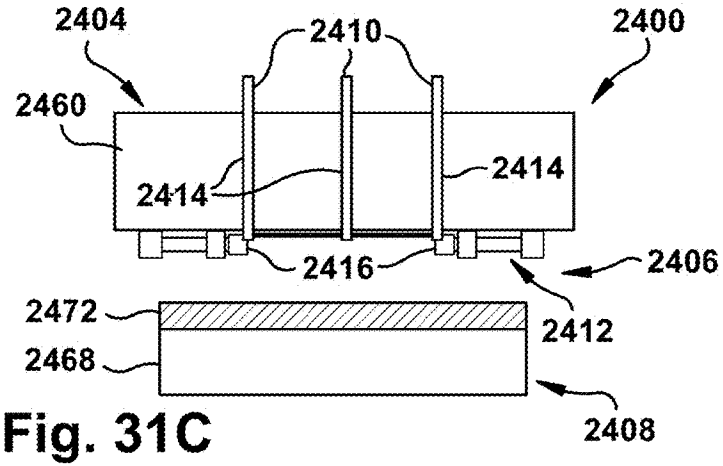
FIG. 31C is a top view of the apparatus and elongated web shown in FIG. 31A.
Figure 31A:
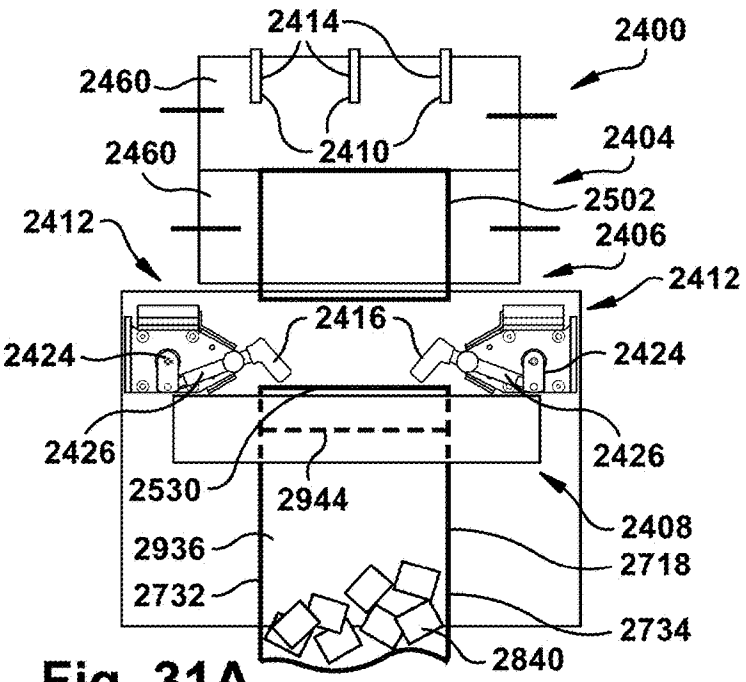
FIG. 31A is a front view of the apparatus showing releasing the filled and sealed bag from the apparatus.
Figure 31B:
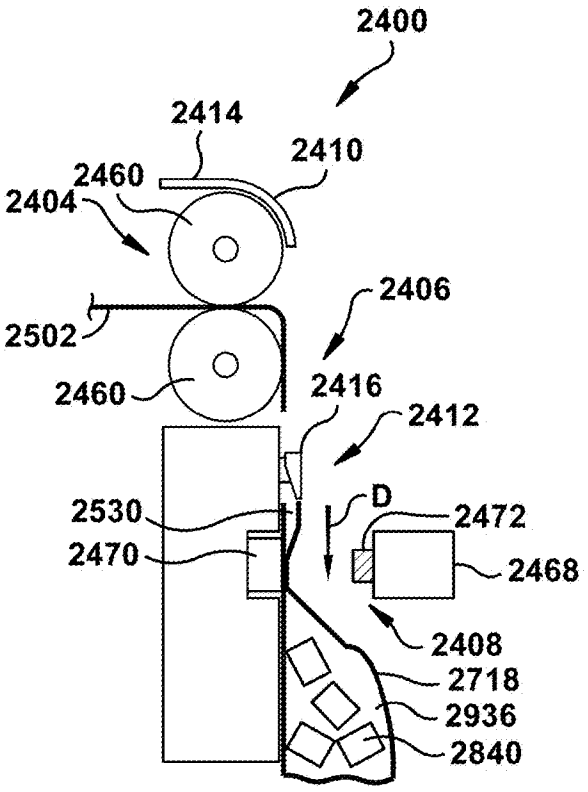
FIG. 31B is a side view of the apparatus and elongated web shown in FIG. 31A.

Referring to FIGS. 31A-31C, the controller controls the sealing arrangement 2408 and the engagement device 2412 to release the bag 2718 holding product 2840 after the bag 2718 is separated from the web 2502, which causes the bag 2718 to fall in direction D. The engagement device 2412 may be disengaged from the bag 2718 before the bag 2718 is separated from the web, since the bag 2718 is clamped by the sealing arrangement. In the illustrated embodiment, the bag 2718 holding products 2840 is released by moving the seal backing bar 2468 away from the heating element 2470 and retracting the engagement device 2412.

Referring again to FIGS. 26A-26C, the controller controls the indexing mechanism 2404 to move the web 2502 so that the opening 2530 of the next bag 2718 is in the load position and the cycle begins again. The controller may repeat the method described above as required to produce as many packages are needed from the web.

The bags 2718 shown in FIGS. 24A-24C through 31A-31C may take several forms, including the forms provided in FIGS. 14-15 and 19-22.

FIGS. 32A-32G illustrate operation of a pair of engagement devices 2412 to engage an opening 2530 to close and flatten a bag 2718. In an exemplary embodiment, each illustrated engagement device 2412 includes a finger 2416, a first link 2424, a second link 2426, a sliding pivot 3202, a base 3204 and a motor (not shown). The first link 2424 is pivotably connected to and moves the corresponding second link 2426. The second link 2426 moves the finger 2416. The sliding pivots 3202 are coupled to corresponding second links 2426 in a manner that allows the second links 2426 to pivot and slide, and sliding pivots 3202 are pivotably connected to base 3204.

Figure 32A:
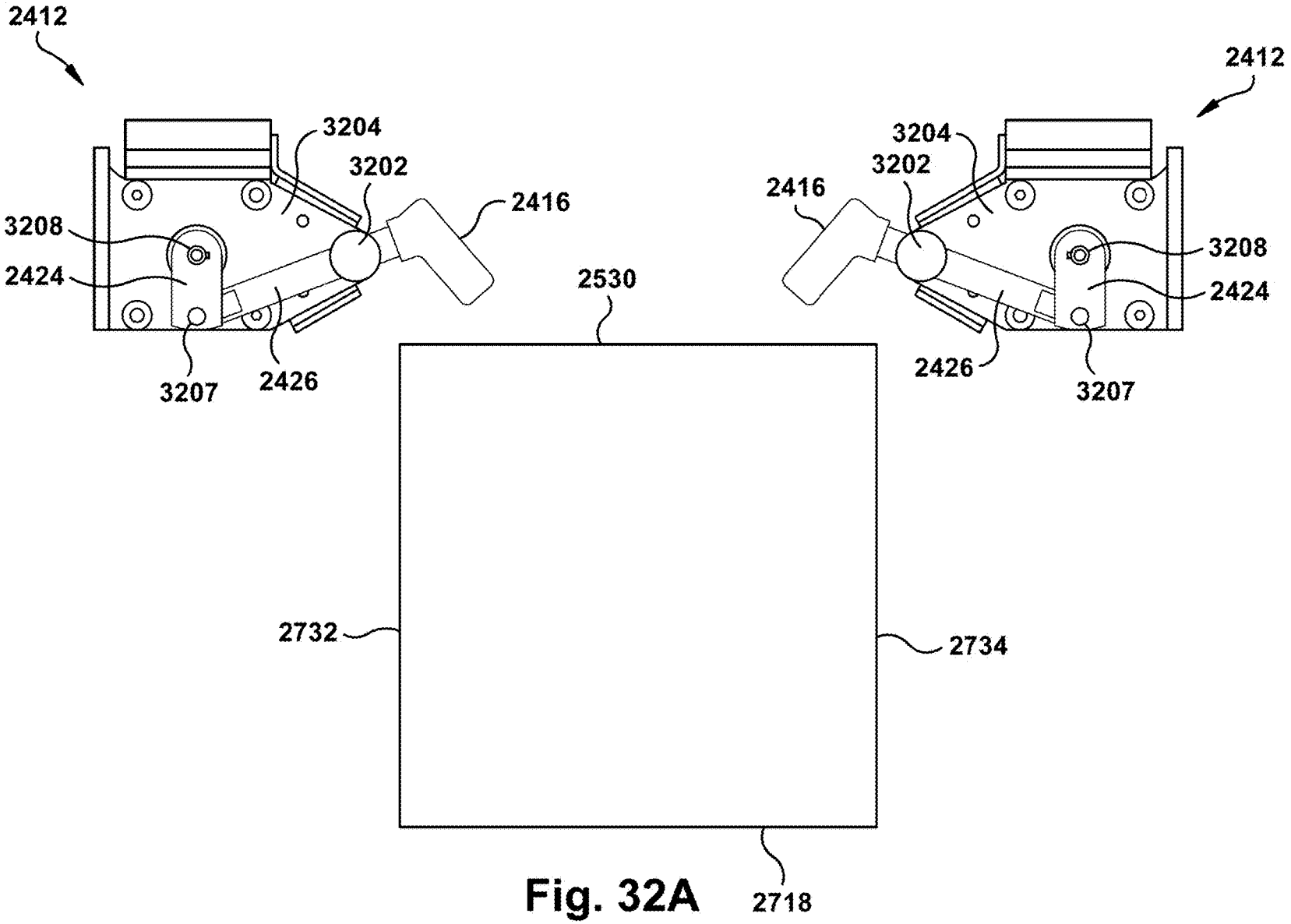
FIG. 32A-32G illustrate an exemplary engagement device of the exemplary apparatus of FIG. 24A engaging with a bag.

In one embodiment, each engagement device 2412 is driven by a motor (not shown). The motor may be, for example, a stepper motor, a motor including pneumatic rotary cylinders, or any other suitable motor for controlling the movement of the first link. Each first link 2424 and each second link 2426 starts in a first position, which is illustrated in FIG. 32A. When the first link 2424 and second link 2426 are in the first position and the bag 2718 is in a loading position, the finger 2416 is located above the opening 2530 of the bag 2718. As illustrated in FIG. 32G, the motor causes the first link 2424 and second link to move to a second position, which causes the fingers 2416 to move downward and enter the opening 2530 of the bag 2718 and pull the sides 2732, 2734 of bag 2718 in opposite directions, which closes and flattens the opening 2530 of bag 2718. In one embodiment, the angle between the first link 2424 in the first position and the first link 2424 in the second position is substantially 180 degrees. First link 2424 can be rotated 360 degrees so the motor only needs to rotate the link in one direction. Obviously, the configuration of the links would need to be changed to accommodate the 360 degree rotation. However, the angle between the first link 2424 in the first position and the first link 2424 in the second position may be any angle that causes the fingers 2416 to pull the sides 2732, 2734 in opposite directions to close and flatten the opening 2530 of bag 2718.

FIGS. 32A-32E illustrates an exemplary embodiment of the movement of the fingers 2416 from above the bag 2718, as shown in FIG. 32A, to pulling the sides of the bag 2718 in opposite directions, as shown in FIG. 32G. FIG. 32A illustrates the fingers 2416 when the first links 2424 and second links 2426 are in the first position. In the illustrated embodiment, the connection points 3208 between the drive systems of the motors and the first links 2424 are along a horizontal axis, and the first links 2424 are substantially perpendicular to the horizontal axis so that the connection point 3207 between the first links 2424 and the second links 2426 are below the connection points 3208 for the drive systems of the motors and the first links 2424.

Figure 32B:
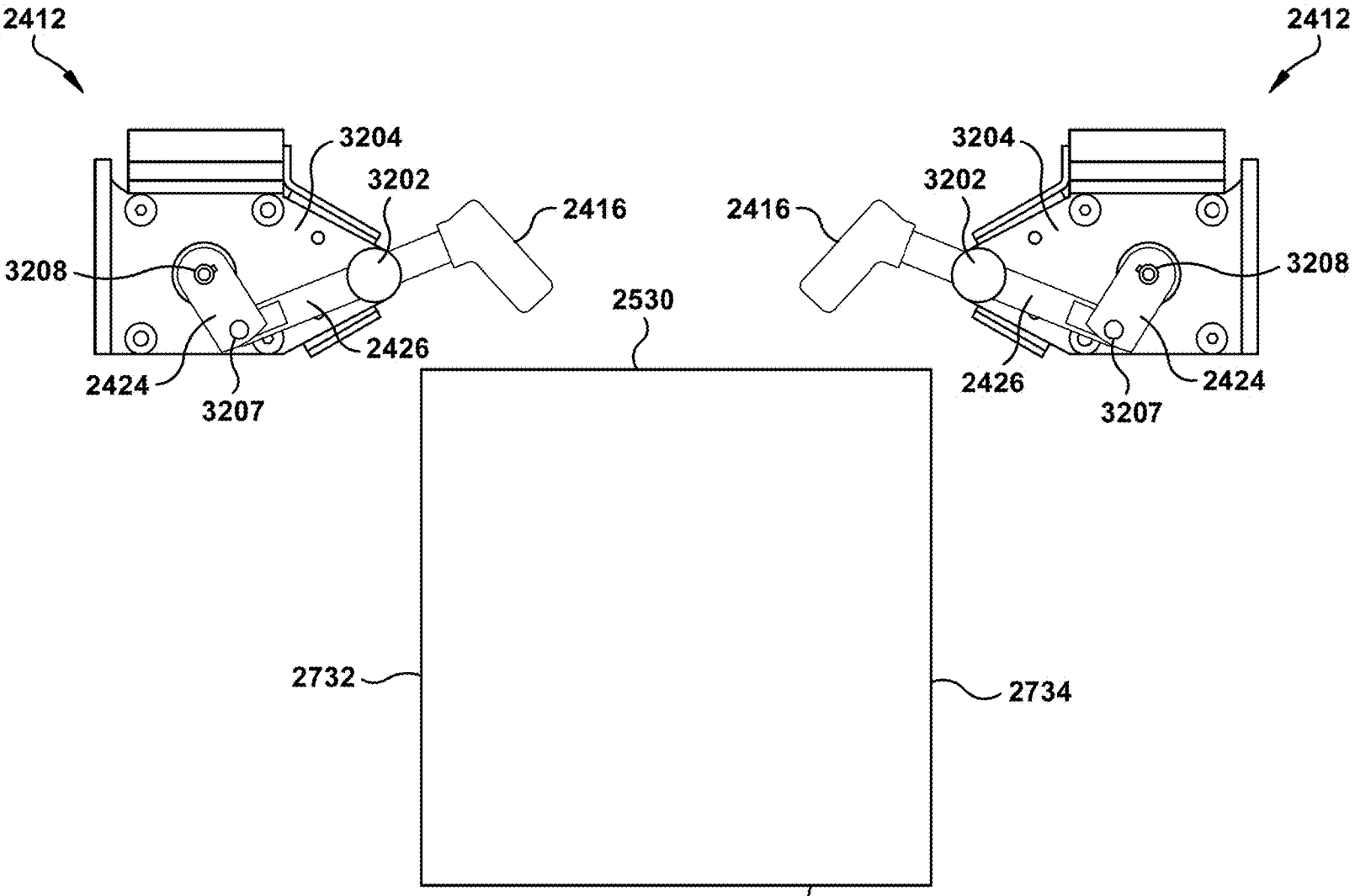

Referring to FIG. 32B and the left engagement device 2412, the first link 2424 moved from the first position in a counterclockwise direction. The first link 2424 caused the second link 2426 to slide through sliding pivot 3202, which caused finger 2416 to raise and move inward relative to the bag 2718. Referring to FIG. 32B and the right engagement device 2412, the first link 2424 moved from the first position in a clockwise direction. The first link 2424 caused the second link 2426 to slide through sliding pivot 3202, which caused finger 2416 to raise and move inward relative to the bag 2718.

Figure 32C:
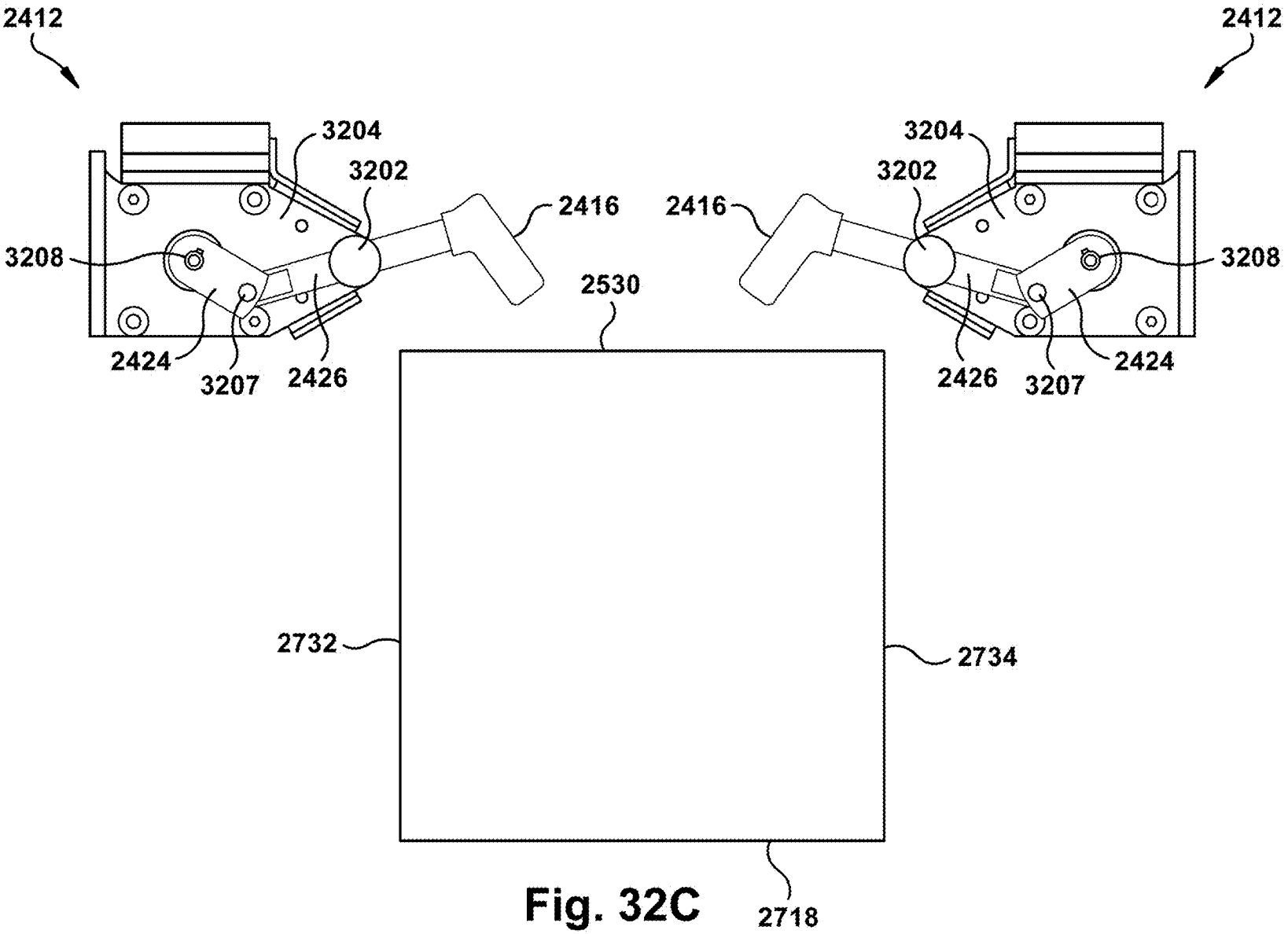

Referring to FIG. 32C and the left engagement device 2412, the first link 2424 continued its motion in a counterclockwise direction. The first link 2424 caused the second link 2426 to slide further inward through sliding pivot 3202, and sliding pivot 3202 pivoted, which caused finger 2416 to begin to move in a downward direction toward bag 2718. Referring to FIG. 32C and the right engagement device 2412, the first link 2424 continued its motion in a clockwise direction. The first link 2424 caused the second link 2426 to slide further inward through sliding pivot 3202, and sliding pivot 3202 pivoted, which caused finger 2416 to begin to move in a downward direction toward bag 2718.

Figure 32D:
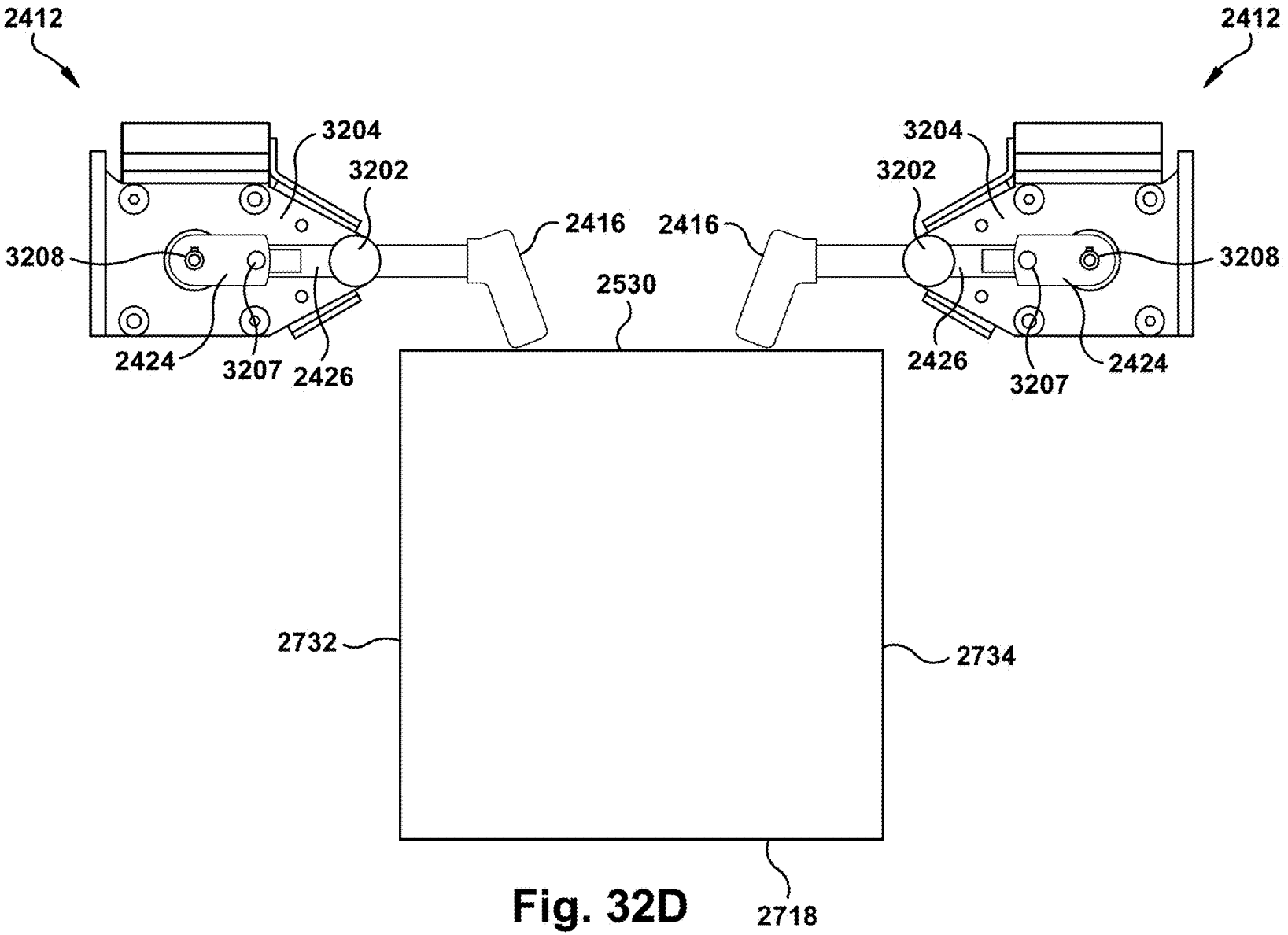

Referring to FIG. 32D and the left engagement device 2412, the first link 2424 continued its motion in a counterclockwise direction. The first link 2424 caused the second link 2426 to slide further through sliding pivot 3202, and sliding pivot 3202 continued to pivot, which caused finger 2416 to continue to move inward and in a downward direction toward bag 2718. In this position, the second link 2426 is in a substantially horizontal position and is fully extended through sliding pivot 3202. Referring to FIG. 32D and the right engagement device 2412, the first link 2424 continued its motion in a clockwise direction. The first link 2424 caused the second link 2426 to slide further through sliding pivot 3202, and sliding pivot 3202 continued to pivot, which caused finger 2416 to continue to move inward and in a downward direction toward bag 2718. In this position, the second link 2426 is in a substantially horizontal position and is fully extended through sliding pivot 3202.

Figure 32E:
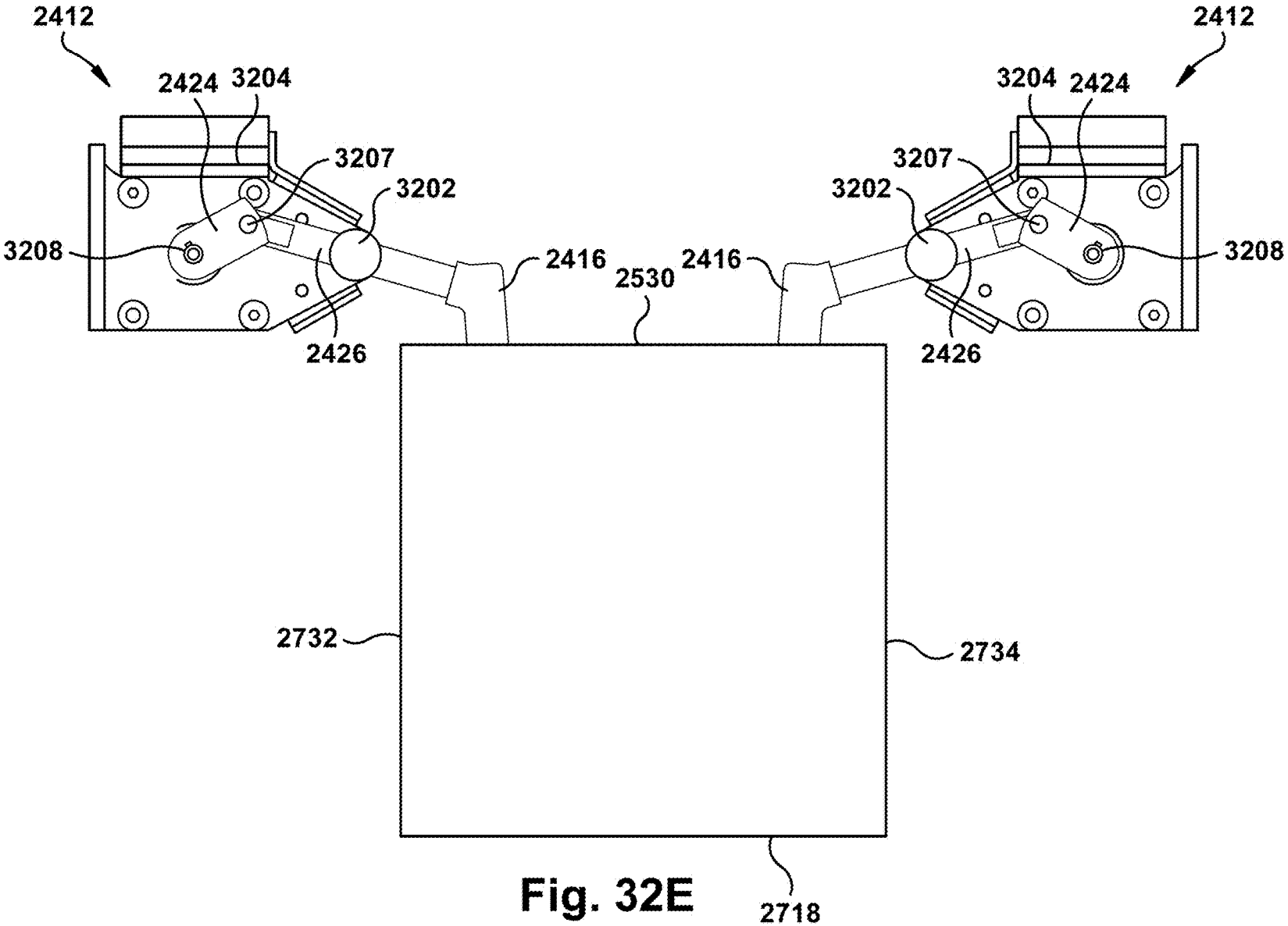

Referring to FIG. 32E and the left engagement device 2412, the first link 2424 continued its motion in a counter-clockwise direction. The first link 2424 caused the second link 2426 to slide back through sliding pivot 3202, and sliding pivot 3202 continued to pivot, which caused finger 2416 to continue to move back toward the side edge 2732 of the bag 2718 and to move in a downward direction and enter bag 2718. Referring to FIG. 32E and the right engagement device 2412, the first link 2424 continued its motion in a clockwise direction. The first link 2424 caused the second link 2426 to slide back through sliding pivot 3202, and sliding pivot 3202 continued to pivot, which caused finger 2416 to continue to move back toward the side edge 2734 of the bag 2718 and to move in a downward direction and enter bag 2718.

Figure 32F:
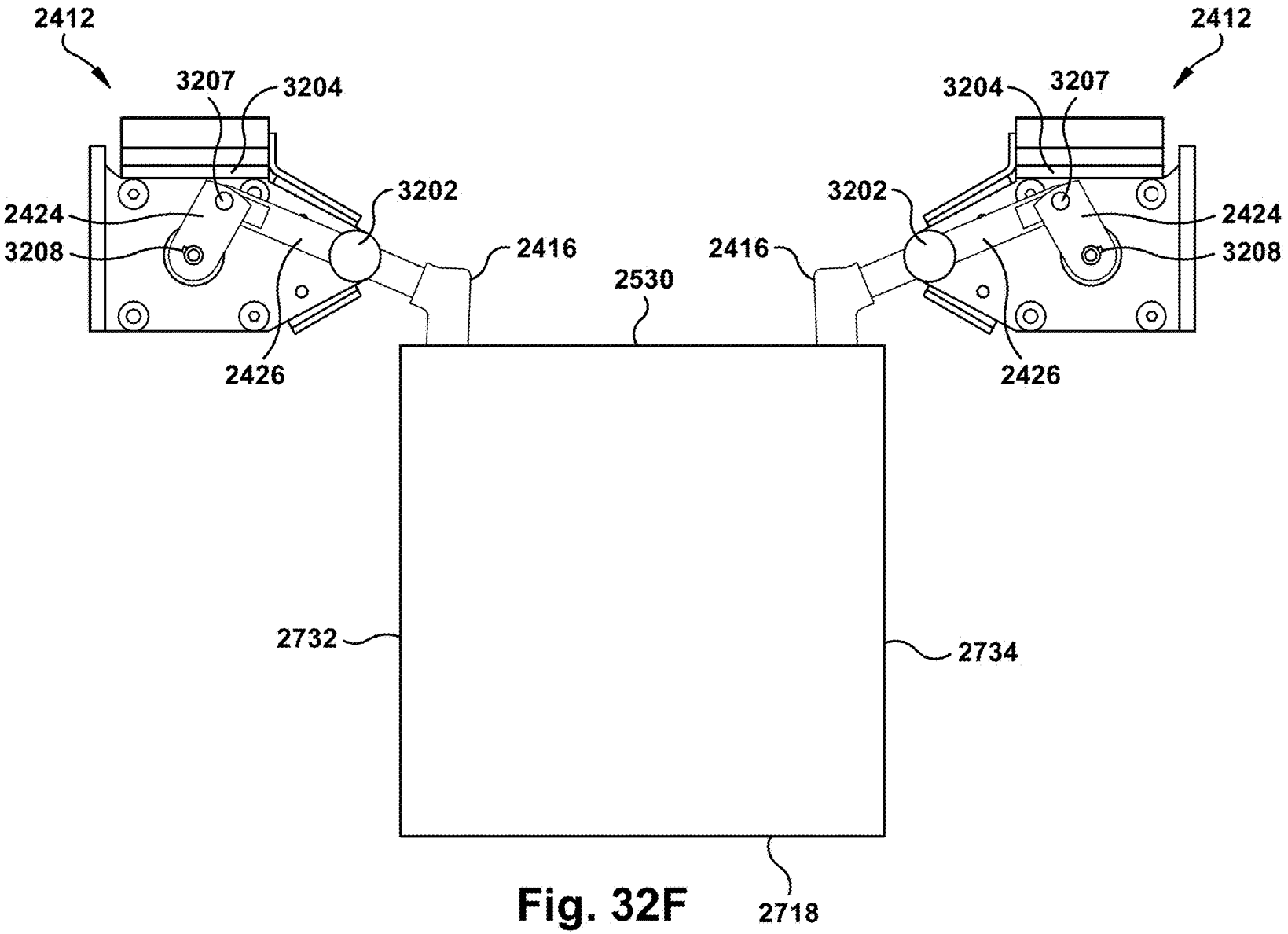
Figure 32G:
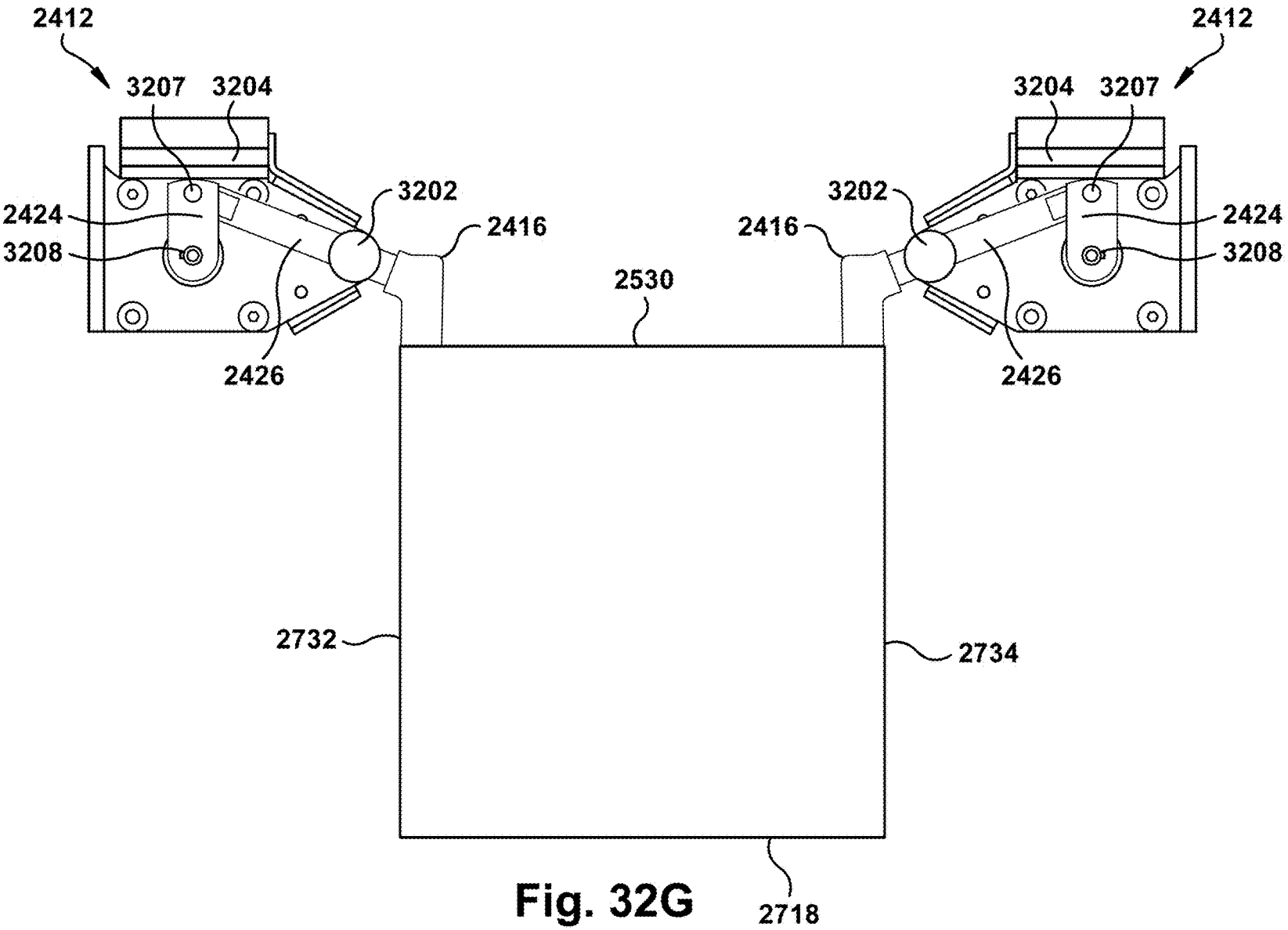

Referring to FIG. 32F and the left engagement device 2412, the first link 2424 continued its motion in a counter-clockwise direction. The first link 2424 caused the second link 2426 to further slide back through sliding pivot 3202, and sliding pivot 3202 continued to pivot, which caused finger 2416 to move toward the side edge 2732 of the bag 2718. In the position illustrated by FIG. 32F, an engagement surface 3290 is parallel or substantially parallel to the side edge of the bag 2718. Referring to FIG. 32F and the right engagement device 2412, the first link 2424 continued its motion in a clockwise direction. The first link 2424 caused the second link 2426 to further slide back through sliding pivot 3202, and sliding pivot 3202 continued to pivot, which caused finger 2416 to move toward the side edge 2734 of the bag 2718. In the position illustrated by FIG. 32F, the engagement surface 3290 is parallel or substantially parallel to the side edge 2734 of the bag 2718.

Referring to FIG. 32G and the left engagement device 2412, the first link 2424 continued its motion in a counter-clockwise direction to arrive at the second position. The first link 2424 caused the second link 2426 to further slide back through sliding pivot 3202 and arrive at the second position, which caused finger 2416 to engage bag 2718 and pull side 2732 of bag 2718 away from side 2734 of bag 2718. Referring to FIG. 32G and the right engagement device 2412, the first link 2424 continued its motion in a clockwise direction to arrive at the second position. The first link 2424 caused the second link 2426 to further slide back through sliding pivot 3202 and arrive at the second position, which caused finger 2416 to engage bag 2718 and pull side 2734 of bag 2718 away from side 2732 of bag 2718. When the left and right engagement devices 2412 are both in the second position, the engagement devices 2412 cause the opening 2530 of bag 2718 to flatten and close. In the position illustrated by FIG. 32G, the engagement surfaces 3290 are parallel or substantially parallel to the sides 2732, 2734 of the bag 2718. This distributes the force applied by the engagement devices 2412 over a larger area of the sides 2732, 2734 of the bag 2718. Once the opening 2530 of bag 2718 is flattened and closed, the sealing arrangement 2408 seals the bag, as discussed above.

The engagement devices 2412 may take a wide variety of different forms. For example, any motor may be used that allows fingers 2416 to enter bag 2718 and pull the sides of bag 2718 in opposite directions. In addition, each first link 2424 may move in any angle that allows each finger 2416 to enter bag 2718 and pull the sides 2732, 2734 of bag 2718 in opposite directions. Also, each second link 2426 may be a fixed length, or the length of each second link 2426 may be adjustable and/or resiliently extendable to allow each second link 2426 to extend or retract for different bag sizes or misalignments. Additionally, each finger 2416 may be any size and/or shape that allows each finger 2416 to engage the sides 2732, 2734 of the bag 2718 and pull the sides 2732, 2734 of the bag 2718 in opposite directions.

It should be understood that the embodiments discussed above are representative of aspects of the invention and are provided as examples and not an exhaustive description of implementations of an aspect of the invention.

While various aspects of the invention are described and illustrated herein as embodied in combination in the exemplary embodiments, these various aspects may be realized in many alternative embodiments, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, software, hardware, control logic and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however, such values and ranges are not to be construed in a limiting sense and are intended to be critical values or ranges only if so expressly stated.

What is claimed is:

1. An engagement device comprising:

a base member;

a first link pivotably connected to the base member at a first connection point;

a sliding pivot pivotably connected to the base member;

a second link pivotably connected to the first link at a second connection point and slidably connected to the sliding pivot, so that the second link is capable of sliding through the sliding pivot; and a finger connected to the second link;

wherein the first connection point and the sliding pivot are connected to the base member such that, when the first link pivots with respect to the base member at the first connection point and the second link slides with respect to the base member at the second connection point, positions of the first connection point and the sliding pivot do not change with respect to either the base member or each other.

2. The engagement device of claim 1, wherein the first link is capable of being driving though a first position, an intermediate position, and a second position.

3. The engagement device of claim 2, wherein, as the first link is driven from the first position through the intermediate position to the second position, movement of the first link causes the second link to:

slide out through the sliding pivot such that the finger is farther from the sliding pivot when the first link is in the intermediate position than when the first link is in the first position; and slide back through the sliding pivot such that the finger is closer to the sliding pivot when the first link is in the second position than when the first link is in the intermediate position.

4. The engagement device of claim 3, wherein:

the sliding out of the second link through the sliding pivot as the first link moves from the first position to the intermediate position causes the finger to initially raise and then move downward with respect to a plane that passes through the first connection point and the sliding pivot; and the sliding back of the second link through the sliding pivot as the first link moves from the intermediate position to the second position causes the finger to initially move downward and then raise with respect to the plane that passes through the first connection point and the sliding pivot.

5. The engagement device of claim 4, wherein the engagement device is configured to be positioned such that the plane that passes through the first connection point and the sliding pivot is substantially horizontal.

6. The engagement device of claim 5, wherein, when the first link is in the intermediate position, the first and second links are in substantially horizontal positions and the second link is fully extended through the sliding pivot.

7. The engagement device of claim 4, wherein the finger includes an engagement surface, and wherein the engagement surface of the finger is substantially perpendicular to the plane that passes through the first connection point and the sliding pivot when the first link is in the second position.

8. An apparatus for making packages from a web of interconnected bags, the apparatus comprising:

an indexing mechanism configured to move the web of interconnected bags along a path of travel;

a pair of engagement devices configured to engage a bag and close an opening of the bag, each of the pair of engagement devices having:

a base member, a first link pivotably connected to the base member at a first connection point, a sliding pivot pivotably connected to the base member, a second link pivotably connected to the first link at a second connection point and slidably connected to the sliding member so that the second link is capable of sliding through the sliding pivot, and a finger connected to the second link, wherein the first connection point and the sliding member are connected to the base member such that, when the first link pivots with respect to the base member at the first connection point and the second link slides with respect to the base member at the second connection point, positions of the first connection point and the sliding member do not change with respect to either the base member or each other; and a sealing arrangement configured to seal the opening of the bag.

9. The apparatus of claim 8, wherein the first link of each of the pair of engagement devices is capable of being driving though a first position, an intermediate position, and a second position.

10. The apparatus of claim 9, wherein, as the first link of each of the pair of engagement devices is driven from the first position through the intermediate position to the second position, movement of the first link causes the second link to:

slide out through the sliding pivot such that the finger is farther from the sliding pivot and more inward relative to the bag when the first link is in the intermediate position than when the first link is in the first position; and slide back through the sliding pivot such that the finger is closer to the sliding pivot and closer to a side of the bag when the first link is in the second position than when the first link is in the intermediate position.

11. The apparatus of claim 10, wherein:

the sliding out of the second link of each of the pair of engagement devices through the sliding pivot as the first link moves from the first position to the intermediate position causes the finger to initially raise away from the bag and then move downward toward the bag; and the sliding back of the second link of each of the pair of engagement devices through the sliding pivot as the first link moves from the intermediate position to the second position causes the finger to initially move downward into the bag and towards the side of the bag and then raise with respect to the bag.

12. The apparatus of claim 11, wherein the sliding back of the second link of each of the pair of engagement devices through the sliding pivot as the first link moves from the intermediate position to the second position further causes the fingers of the pair of engagement devices to pull sides of the bag away from each other to cause the opening of the bag to flatten and close.

13. The apparatus of claim 12, wherein the sealing arrangement is configured to seal the opening of the bag after the opening of the bag has been flattened and closed by the fingers of the pair of engagement devices.

14. The apparatus of claim 11, wherein each of the pair of engagement devices is positioned in the apparatus such that a plane that passes through the first connection point and the sliding pivot is substantially horizontal.

15. The apparatus of claim 14, wherein, when the first link is in the intermediate position, the first and second links are in substantially horizontal positions and the second link is fully extended through the sliding pivot.

16. The apparatus of claim 11, wherein the finger includes an engagement surface, and wherein the engagement surface of the finger is substantially parallel to the side of the bag when the first link is in the second position.

* * * * *